US011623441B2

(12) United States Patent
Komatsu et al.

(10) Patent No.: US 11,623,441 B2
(45) Date of Patent: Apr. 11, 2023

(54) LIQUID EJECTING APPARATUS AND MAINTENANCE METHOD OF LIQUID EJECTING APPARATUS

(71) Applicant: SEIKO EPSON CORPORATION, Tokyo (JP)

(72) Inventors: Shinya Komatsu, Shiojiri (JP); Hitotoshi Kimura, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 140 days.

(21) Appl. No.: 17/065,887

(22) Filed: Oct. 8, 2020

(65) Prior Publication Data

US 2021/0107277 A1 Apr. 15, 2021

(30) Foreign Application Priority Data

Oct. 11, 2019 (JP) ..... JP2019-187708

(51) Int. Cl.
*B41J 2/03* (2006.01)
*B41J 2/175* (2006.01)

(52) U.S. Cl.
CPC ..... *B41J 2/03* (2013.01); *B41J 2/175* (2013.01); *B41J 2002/031* (2013.01); *B41J 2202/07* (2013.01)

(58) Field of Classification Search
CPC ..... B41J 2/03; B41J 2/175; B41J 2002/031; B41J 2202/07; B41J 2002/14354; B41J 2/0451; B41J 2/04581; B41J 2/17596; B41J 2/18; B41J 2/185
USPC ..... 347/20
See application file for complete search history.

(56) References Cited

U.S. PATENT DOCUMENTS

2008/0049084 A1* 2/2008 Katada ..... B41J 2/18 347/92
2014/0285587 A1 9/2014 Kida et al.
2014/0285596 A1* 9/2014 Ando ..... B41J 2/21 347/92

FOREIGN PATENT DOCUMENTS

| | | | |
|---|---|---|---|
| EP | 3088186 | A | 11/2016 |
| JP | 2005-059476 | A | 3/2005 |
| JP | 2007-021723 | A | 2/2007 |
| JP | 2007-190703 | A | 8/2007 |
| JP | 2014-180857 | A | 9/2014 |
| JP | 2014-208421 | A | 11/2014 |
| JP | 2015-000518 | A | 1/2015 |
| WO | WO15/098220 | | 7/2015 |

* cited by examiner

*Primary Examiner* — Christopher E Mahoney
*Assistant Examiner* — Alexander D Shenderov
(74) *Attorney, Agent, or Firm* — Workman Nydegger

(57) ABSTRACT

A liquid ejecting apparatus including a liquid ejecting portion that ejects a liquid in a pressure chamber from a nozzle that communicates with the pressure chamber, a liquid supply flow path that supplies the liquid stored in a liquid storing portion to the liquid ejecting portion, a degas module provided in the liquid supply flow path, a vacuum degree adjustment mechanism configured to adjust a vacuum degree of the degas module, a state detecting mechanism configured to detect a state inside the pressure chamber, and a control portion that drives and controls the vacuum degree adjustment mechanism based on a detecting result of the state detecting mechanism.

10 Claims, 9 Drawing Sheets

LIQUID EJECTING APPARATUS AND MAINTENANCE METHOD OF LIQUID EJECTING APPARATUS

The present application is based on, and claims priority from JP Application Serial Number 2019-187708, filed Oct. 11, 2019, the disclosure of which is hereby incorporated by reference here in its entirety.

BACKGROUND

1. Technical Field

The present disclosure relates to a liquid ejecting apparatus such as a printer and a maintenance method of the liquid ejecting apparatus.

2. Related Art

For example, as disclosed in JP-A-2005-59476, there is an ink supply apparatus that can be used in an ink jet printing machine that is an example of a liquid ejecting apparatus that discharges and prints ink that is an example of liquid from a head portion that is an example of a liquid ejecting portion. The ink supply apparatus includes a flow path that is an example of a liquid supply flow path that supplies ink supplied from a main tank, which is an example of a liquid storing portion, to the head portion, and a degassing apparatus that is an example of a degas module that is disposed in the flow path. The degassing apparatus degases the ink by drawing a vacuum with a vacuum pump, which is an example of a vacuum degree adjustment mechanism.

When the vacuum degree at a time when the vacuum degree adjustment mechanism degases the liquid is determined based on the specifications of the vacuum degree adjustment mechanism, it is necessary to set the maximum vacuum degree required for degassing. In this case, since a large load is continuously applied to the vacuum degree adjustment mechanism, deterioration of the vacuum degree adjustment mechanism over time is likely to proceed.

SUMMARY

A liquid ejecting apparatus that solves the above-mentioned problems includes a liquid ejecting portion that ejects a liquid in a pressure chamber from a nozzle that communicates with the pressure chamber, a liquid supply flow path that supplies the liquid stored in a liquid storing portion to the liquid ejecting portion, a degas module provided in the liquid supply flow path, a vacuum degree adjustment mechanism configured to adjust a vacuum degree of the degas module, a state detecting mechanism configured to detect a state inside the pressure chamber, and a control portion that drives and controls the vacuum degree adjustment mechanism based on a detecting result of the state detecting mechanism.

A maintenance method of a liquid ejecting apparatus that solves the above-mentioned problems includes a liquid ejecting portion that ejects a liquid in a pressure chamber from a nozzle that communicates with the pressure chamber, a liquid supply flow path that supplies the liquid stored in a liquid storing portion to the liquid ejecting portion, a degas module provided in the liquid supply flow path, a vacuum degree adjustment mechanism configured to adjust a vacuum degree of the degas module, and a state detecting mechanism configured to detect a state inside the pressure chamber, includes driving the vacuum degree adjustment mechanism based on a detecting result of the state detecting mechanism.

DESCRIPTION OF EXEMPLARY EMBODIMENTS

Figure 1:
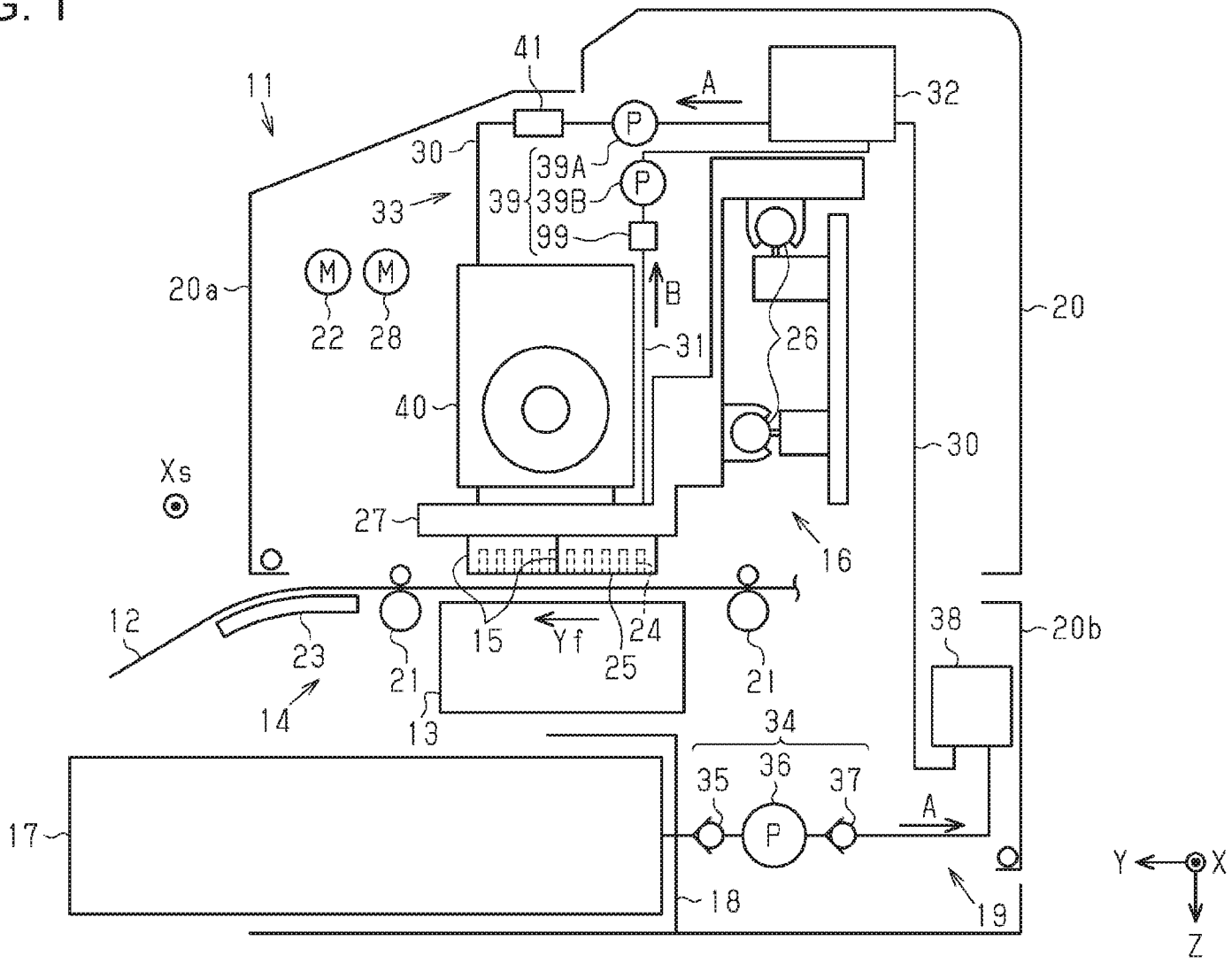
FIG. 1 is a side view schematically illustrating a liquid ejecting apparatus according to an embodiment.

Hereinafter, an embodiment of a liquid ejecting apparatus and a maintenance method for the liquid ejecting apparatus will be described with reference to the drawings. The liquid ejecting apparatus is an ink jet printer that ejects an ink, which is an example of a liquid, onto a medium such as paper to print.

In the drawings, assuming a liquid ejecting apparatus 11 is placed on a horizontal plane, the direction of gravity is indicated by a Z axis, and the directions along the horizontal plane are indicated by an X axis and a Y axis. The X axis, the Y axis, and the Z axis are orthogonal to each other. In the following description, the direction parallel to the Z axis is also referred to as the vertical direction Z.

As illustrated in FIG. 1, the liquid ejecting apparatus 11 may include a support base 13 that supports medium 12, and a transport portion 14 that transports the medium 12. The liquid ejecting apparatus 11 includes a liquid ejecting portion 15 that ejects a liquid toward the medium 12 supported by the support base 13, and a movement mechanism 16 that can move the liquid ejecting portion 15 in a scanning direction Xs.

The liquid ejecting apparatus 11 may include a mounting portion 18 to which a liquid supply source 17 that stores a liquid is detachably mounted, and a liquid supply portion 19 that can supply the liquid to the liquid ejecting portion 15. The liquid ejecting apparatus 11 may include a main body 20 including a housing, a frame, or the like, and a first cover 20*a* and a second cover 20*b* that are attached to the main body 20 to be openable and closable.

In the liquid ejecting apparatus 11, the support base 13 extends in the scanning direction Xs which is also the width direction of the medium 12. The scanning direction Xs of the present embodiment is a direction parallel to the X axis. The support base 13 supports the medium 12 positioned at a printing position.

The transport portion 14 may include a transport roller pair 21 that transports the medium 12 pinched therebetween, a transport motor 22 that rotates the transport roller pair 21, and a guide plate 23 that guides the medium 12. A plurality of transport roller pairs 21 may be provided along the transport path of the medium 12. The transport portion 14 drives the transport motor 22 to transport the medium 12 along the surface of the support base 13. A transport direction Yf in which the transport portion 14 transports the medium 12 is a direction along the transport path of the medium 12, and is a direction along the surface of the support base 13 on which the medium 12 contacts. The transport direction Yf of the present embodiment is parallel to the Y axis at the printing position.

The liquid ejecting apparatus 11 of the present embodiment includes two liquid ejecting portions 15. The two liquid ejecting portions 15 are disposed to be apart from each other in the scanning direction Xs by a predetermined distance and to be displaced in the transport direction Yf by a predetermined distance. The liquid ejecting portion 15 has a nozzle surface 25 on which a nozzle 24 is disposed. The liquid ejecting portion 15 of the present embodiment ejects the liquid in the vertical direction Z from the nozzle 24 toward the medium 12 positioned at the printing position, and prints on the medium 12.

The movement mechanism 16 includes a guide shaft 26 provided to extend in the scanning direction Xs, a carriage 27 supported by the guide shaft 26, and a carriage motor 28 that moves the carriage 27 along the guide shaft 26. The carriage 27 holds the liquid ejecting portion 15 in a posture in which the nozzle surface 25 faces the support base 13 in the vertical direction Z. The first cover 20*a* may be provided to cover a portion of the movement path of the liquid ejecting portion 15. When the liquid ejecting apparatus 11 is provided so that the liquid ejecting portion 15 is exposed to the outside from the opened first cover 20*a*, the liquid ejecting portion 15 can be easily replaced.

The movement mechanism 16 reciprocates the carriage 27 and the liquid ejecting portion 15 in the scanning direction Xs and the direction opposite to the scanning direction Xs, along the guide shaft 26. That is, the liquid ejecting apparatus 11 of the present embodiment is configured as a serial type apparatus in which the liquid ejecting portion 15 reciprocates along the X axis.

The liquid supply source 17 is, for example, a container that stores a liquid. The liquid supply source 17 may be a replaceable cartridge or a tank capable of supplementing the liquid. The liquid ejecting apparatus 11 may include a plurality of liquid supply portions 19 corresponding to the types of liquid ejected from the liquid ejecting portion 15. The liquid ejecting apparatus 11 according to the present embodiment includes four liquid supply portions 19.

The liquid supply portion 19 may include a liquid storing portion 32 that stores the liquid, a liquid supply flow path 30 that supplies the liquid stored in the liquid storing portion 32 to the liquid ejecting portion 15, and a liquid return flow path 31 that returns the liquid that is supplied to the liquid ejecting portion 15 to the liquid storing portion 32. The liquid supply flow path 30 may couple the liquid storing portion 32 and the liquid ejecting portion 15 or may couple the liquid supply source 17 and the liquid ejecting portion 15. The liquid storing portion 32 of the present embodiment is provided in the way of the liquid supply flow path 30 that couples the liquid supply source 17 and the liquid ejecting portion 15. The liquid return flow path 31 may couple the liquid ejecting portion 15 and the liquid storing portion 32, or may couple an upstream position of a supply direction A and the liquid ejecting portion 15 rather than the liquid storing portion 32 in the liquid supply flow path 30. That is, the liquid return flow path 31 may couple the liquid ejecting portion 15 and the liquid storing portion 32 via a portion of the liquid supply flow path 30. The liquid return flow path 31 can form a circulation path 33 together with the liquid supply flow path 30.

The liquid supply portion 19 may include a deriving pump 34 that derives the liquid from the liquid supply source 17. The deriving pump 34 may include a suction valve 35, a volumetric pump 36, and a discharge valve 37. The suction valve 35 is positioned upstream of the supply direction A compared to the volumetric pump 36 in the liquid supply flow path 30. The discharge valve 37 is positioned downstream of the supply direction A compared to the volumetric pump 36 in the liquid supply flow path 30. The suction valve 35 and the discharge valve 37 are configured to allow the liquid flow from the upstream side to the downstream side in the liquid supply flow path 30 and inhibit the liquid flow from the downstream side to the upstream side.

The liquid supply portion 19 may include a filter unit 38 that captures air bubbles and foreign matter in the liquid. The filter unit 38 may be detachably attached to the liquid supply flow path 30. When the liquid ejecting apparatus 11 is provided so that the filter unit 38 is exposed to the outside from the opened second cover 20*b*, the filter unit 38 can be easily replaced. The filter unit 38 may be positioned in the liquid supply flow path 30 at a position between the deriving pump 34 and the liquid storing portion 32. The liquid return flow path 31 may be coupled to the liquid supply flow path 30 at a position between the deriving pump 34 and the filter unit 38.

The liquid supply portion 19 includes a flow path flowing mechanism 39 capable of flowing the liquid inside the liquid supply flow path 30 and in the liquid return flow path 31, a degas module 41 provided in the liquid supply flow path 30, and a pressure adjustment apparatus 40 adjusting the pressure of the liquid supplied to the liquid ejecting portion 15. The flow path flowing mechanism 39 may have a supply pump 39A provided in the liquid supply flow path 30, a return pump 39B provided in the liquid return flow path 31, and a return valve 99. The supply pump 39A can flow the liquid inside the liquid supply flow path 30 from the liquid storing portion 32 toward the liquid ejecting portion 15 in the supply direction A. The return pump 39B can flow the liquid inside the liquid return flow path 31 from the liquid ejecting portion 15 toward the liquid storing portion 32 in a return direction B. The return valve 99 can adjust the passage cross-sectional area of the liquid return flow path 31 by adjusting the opening degree.

Figure 2:
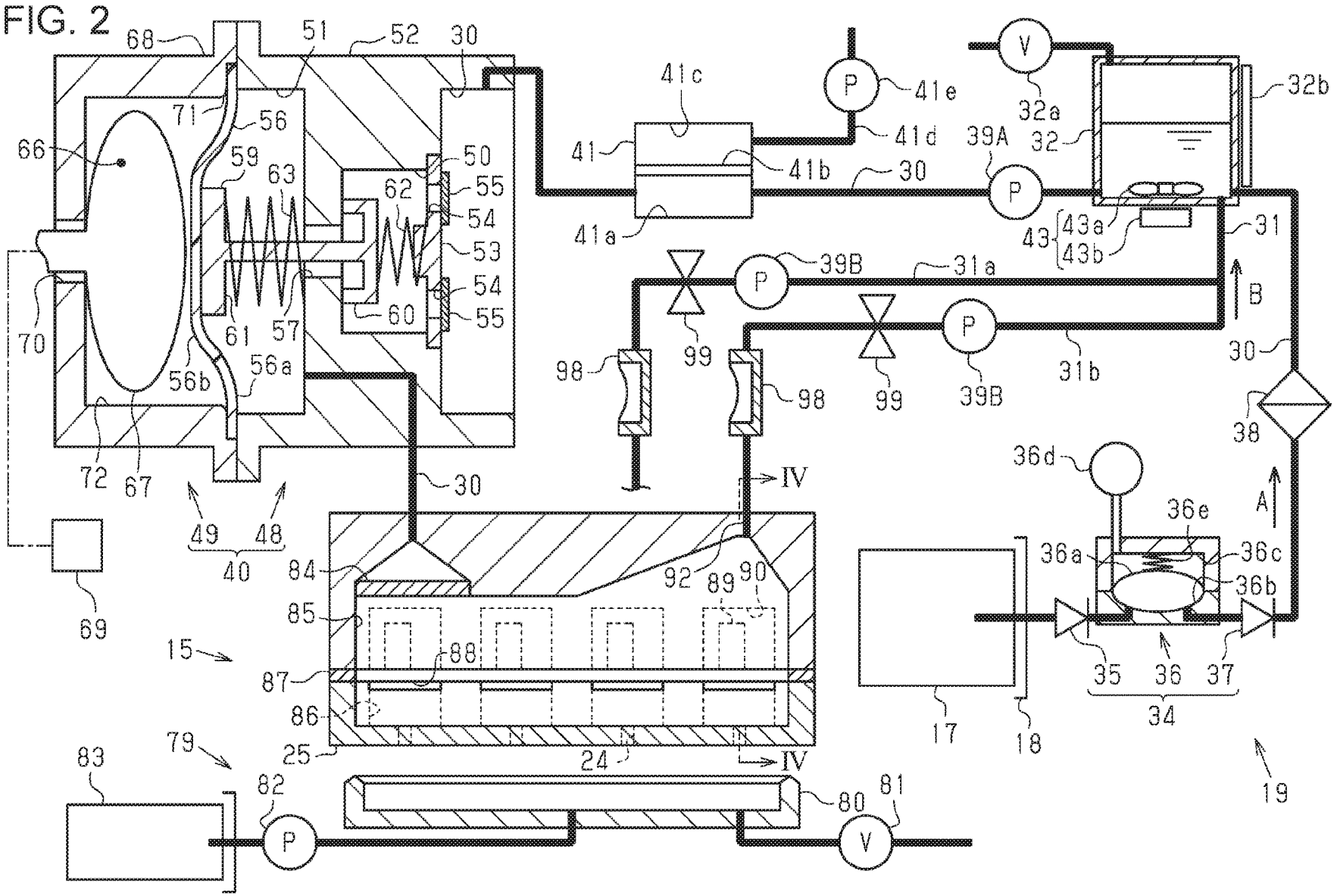
FIG. 2 is a sectional view schematically illustrating a liquid ejecting portion and a liquid supply portion.

As illustrated in FIG. 2, the degas module 41 has a degassing chamber 41*a* temporarily storing a liquid, a decompression chamber 41*c* partitioned from the degassing chamber 41*a* by a degassing film 41*b*, a decompression flow path 41*d* connected to the decompression chamber 41*c*, and a vacuum degree adjustment mechanism 41*e* capable of adjusting the vacuum degree of the degas module 41. The degassing film 41*b* has a property of passing gas but not liquid. The vacuum degree adjustment mechanism 41*e* is a pump capable of adjusting the vacuum degree of the decompression chamber 41*c* by adjusting the internal pressure of the decompression chamber 41*c* through the decompression flow path 41*d*. The vacuum degree in the decompression chamber 41*c* increases as the decompression chamber 41*c* is decompressed by driving the vacuum degree adjustment mechanism 41*e*. Since the vacuum degree of the degassing chamber 41*a* is adjusted according to the vacuum degree of the decompression chamber 41*c*, air bubbles, dissolved gas, or the like mixed in the liquid stored in the degassing chamber 41*a* are removed.

The volumetric pump 36 has a pump chamber 36*b* partitioned by a flexible member 36*a* and a negative pressure chamber 36*c*. The volumetric pump 36 has a decompression portion 36*d* for decompressing the negative pressure chamber 36*c*, and a holding member 36*e* that is provided in the negative pressure chamber 36*c* and presses the flexible member 36*a* toward the side of the pump chamber 36*b*.

The deriving pump 34 sucks the liquid from the liquid supply source 17 via the suction valve 35 as the volume of the pump chamber 36*b* increases. The deriving pump 34 pressurizes the liquid by the holding member 36*e* pressing the liquid inside the pump chamber 36*b* via the flexible member 36*a*. The deriving pump 34 discharges the liquid toward the liquid ejecting portion 15 via the discharge valve 37 as the volume of the pump chamber 36*b* decreases. The pressurizing force with which the deriving pump 34 pressurizes the liquid is set by the pressing force of the holding member 36*e*.

The liquid supply portion 19 may include a storage opening valve 32*a* that opens the space inside the liquid storing portion 32 to the atmosphere, a storage amount detecting portion 32*b* that detects the amount of liquid stored in the liquid storing portion 32, and a stirring mechanism 43 capable of stirring the liquid inside the liquid storing portion 32. The stirring mechanism 43 may have a stirrer 43*a* provided in the liquid storing portion 32 and a rotating portion 43*b* rotating the stirrer 43*a*.

Next, the pressure adjustment apparatus 40 will be described.

As illustrated in FIG. 2, the pressure adjustment apparatus 40 may include a pressure adjustment mechanism 48 that constitutes a portion of the liquid supply flow path 30, and a pressing mechanism 49 that presses the pressure adjustment mechanism 48. The pressure adjustment mechanism 48 has a liquid inflow portion 50 into which the liquid supplied from the liquid supply source 17 through the liquid supply flow path 30 flows and a main body portion 52 in which a liquid outflow portion 51 capable of storing the liquid therein is formed.

The liquid supply flow path 30 and the liquid inflow portion 50 are partitioned by a wall 53 of the main body portion 52, and communicate with each other through a through hole 54 formed in the wall 53. The through hole 54 is covered with a filter member 55. Accordingly, the liquid in the liquid supply flow path 30 is filtered by the filter member 55 and flows into the liquid inflow portion 50.

At least a part of the wall surface of the liquid outflow portion 51 is formed by a diaphragm 56. The diaphragm 56 receives the pressure of the liquid inside the liquid outflow portion 51 on a first surface 56*a* which is the inner surface of the liquid outflow portion 51. The diaphragm 56 receives the atmospheric pressure on a second surface 56*b* which is the outer surface of the liquid outflow portion 51. Accordingly, the diaphragm 56 is displaced according to the pressure inside the liquid outflow portion 51. The volume of the liquid outflow portion 51 changes as the diaphragm 56 is displaced. The liquid inflow portion 50 and the liquid outflow portion 51 communicate with each other through a communication path 57.

The pressure adjustment mechanism 48 has an open/close valve 59 that can switch between a closed valve state in which the liquid inflow portion 50 and the liquid outflow portion 51 are blocked in the communication path 57 and an open valve state in which the liquid inflow portion 50 and the liquid outflow portion 51 communicate. The open/close valve 59 illustrated in FIG. 2 is in a closed valve state. The open/close valve 59 has a valve portion 60 capable of blocking the communication path 57 and a pressure receiving portion 61 that receives pressure from the diaphragm 56. The open/close valve 59 moves by the pressure receiving portion 61 being pushed by the diaphragm 56.

An upstream holding member 62 is provided in the liquid inflow portion 50. A downstream holding member 63 is provided in the liquid outflow portion 51. Both the upstream holding member 62 and the downstream holding member 63 press in the direction of closing the open/close valve 59. The open/close valve 59 changes from the closed valve state to the open valve state when the pressure applied to the first surface 56*a* is lower than the pressure applied to the second surface 56*b* and the difference between the pressure applied to the first surface 56*a* and the pressure applied to the second surface 56*b* becomes a predetermined value or more. The predetermined value is, for example, 1 kPa.

The predetermined value is a value determined according to the pressing force of the upstream holding member 62, the pressing force of the downstream holding member 63, the force required to displace the diaphragm 56, the seal load that is the pressing force required to block the communication path 57 by the valve portion 60, the pressure inside the liquid inflow portion 50 acting on the surface of the valve portion 60, and the pressure inside the liquid outflow portion 51. That is, the larger the pressing force of the upstream holding member 62 and the downstream holding member 63, the larger the predetermined value for changing the closed valve state to the open valve state.

The pressing force of the upstream holding member 62 and the downstream holding member 63 is set so that the pressure inside the liquid outflow portion 51 is in a negative pressure state in a range in which a meniscus can be formed at the gas-liquid interface in the nozzle 24. For example, when the pressure applied to the second surface 56*b* is atmospheric pressure, the pressing force of the upstream holding member 62 and the downstream holding member 63 is set so that the pressure inside the liquid outflow portion 51 becomes −1 kPa. In this case, the gas-liquid interface is a boundary on which the liquid and the gas are in contact with each other, and the meniscus is a curved liquid surface formed by the liquid coming into contact with the nozzle 24. It is preferable that a recess-shaped meniscus suitable for ejecting liquid is formed in the nozzle 24.

In the present embodiment, when the open/close valve 59 in the pressure adjustment mechanism 48 is in the closed valve state, the pressure of the liquid upstream of the pressure adjustment mechanism 48 is normally a positive pressure by the deriving pump 34 and the flow path flowing mechanism 39. Specifically, when the open/close valve 59 is in the closed valve state, the pressure of the liquid in the liquid inflow portion 50 and upstream of the liquid inflow portion 50 is normally set to a positive pressure by the deriving pump 34 and the flow path flowing mechanism 39.

In the present embodiment, when the open/close valve 59 is in the closed valve state in the pressure adjustment mechanism 48, the pressure of the liquid downstream of the pressure adjustment mechanism 48 is normally set to a negative pressure by the diaphragm 56. Specifically, when the open/close valve 59 is in the closed valve state, the pressure of the liquid in the liquid outflow portion 51 and downstream of the liquid outflow portion 51 is normally set to a negative pressure by the diaphragm 56.

When the liquid ejecting portion 15 ejects the liquid, the liquid stored in the liquid outflow portion 51 is supplied to the liquid ejecting portion 15 via the liquid supply flow path 30. The pressure inside the liquid outflow portion 51 lowers. Accordingly, when the difference between the pressure applied to the first surface 56*a* and the pressure applied to the second surface 56*b* in the diaphragm 56 is greater than or equal to a predetermined value, the diaphragm 56 is flexibly deformed in the direction in which the volume of the liquid outflow portion 51 is reduced. When the pressure receiving portion 61 is pressed and moved according to the deformation of the diaphragm 56, the open/close valve 59 becomes in the open valve state.

When the open/close valve 59 is in the open valve state, the liquid inside the liquid inflow portion 50 is pressurized by the deriving pump 34 and the flow path flowing mechanism 39, so that the liquid is supplied from the liquid inflow portion 50 to the liquid outflow portion 51. Accordingly, the pressure inside the liquid outflow portion 51 increases. When the pressure inside the liquid outflow portion 51 rises, the diaphragm 56 deforms to increase the volume of the liquid outflow portion 51. When the difference between the pressure applied to the first surface 56*a* and the pressure applied to the second surface 56*b* in the diaphragm 56 becomes smaller than a predetermined value, the open/close valve 59 changes from the open valve state to the closed valve state. Accordingly, the open/close valve 59 impedes the flow of the liquid flowing from the liquid inflow portion 50 toward the liquid outflow portion 51.

As described above, the pressure adjustment mechanism 48 adjusts the pressure of the liquid supplied to the liquid ejecting portion 15 by the displacement of the diaphragm 56, thereby adjusting the pressure inside the liquid ejecting portion 15 that is the back pressure of the nozzle 24.

The pressing mechanism 49 has an expansion/contraction portion 67 forming a pressure adjustment chamber 66 on the side of the second surface 56*b* of the diaphragm 56, a holding member 68 pressing the expansion/contraction portion 67, and a pressure adjustment portion 69 capable of adjusting the pressure inside the pressure adjustment chamber 66. The expansion/contraction portion 67 is formed in a balloon shape, for example, by rubber, resin, or the like. The expansion/contraction portion 67 expands or contracts as the pressure in the pressure adjustment chamber 66 is adjusted by the pressure adjustment portion 69. The holding member 68 is formed to have a bottomed cylindrical shape, for example. A portion of the expansion/contraction portion 67 is inserted into an insertion hole 70 formed at the bottom portion of the holding member 68.

An end edge portion on the side of an opening portion 71 of the inner side surface in the holding member 68 is rounded by being R-chamfered. The holding member 68 is attached to the pressure adjustment mechanism 48 so that the opening portion 71 is closed by the pressure adjustment mechanism 48. Accordingly, the holding member 68 forms an air chamber 72 that covers the second surface 56*b* of the diaphragm 56. The pressure inside the air chamber 72 is atmospheric pressure. Accordingly, the atmospheric pressure acts on the second surface 56*b* of the diaphragm 56.

The pressure adjustment portion 69 expands the expansion/contraction portion 67 by adjusting the pressure inside the pressure adjustment chamber 66 to a pressure higher than the atmospheric pressure which is the pressure in the air chamber 72. The pressing mechanism 49 presses the diaphragm 56 in a direction in which the volume of the liquid outflow portion 51 is reduced by the pressure adjustment portion 69 expanding the expansion/contraction portion 67. At this time, the expansion/contraction portion 67 of the pressing mechanism 49 presses the part in the diaphragm 56 with which the pressure receiving portion 61 contacts. The area of the part in the diaphragm 56 with which the pressure receiving portion 61 contacts is greater than the cross-sectional area of the communication path 57.

Figure 3:
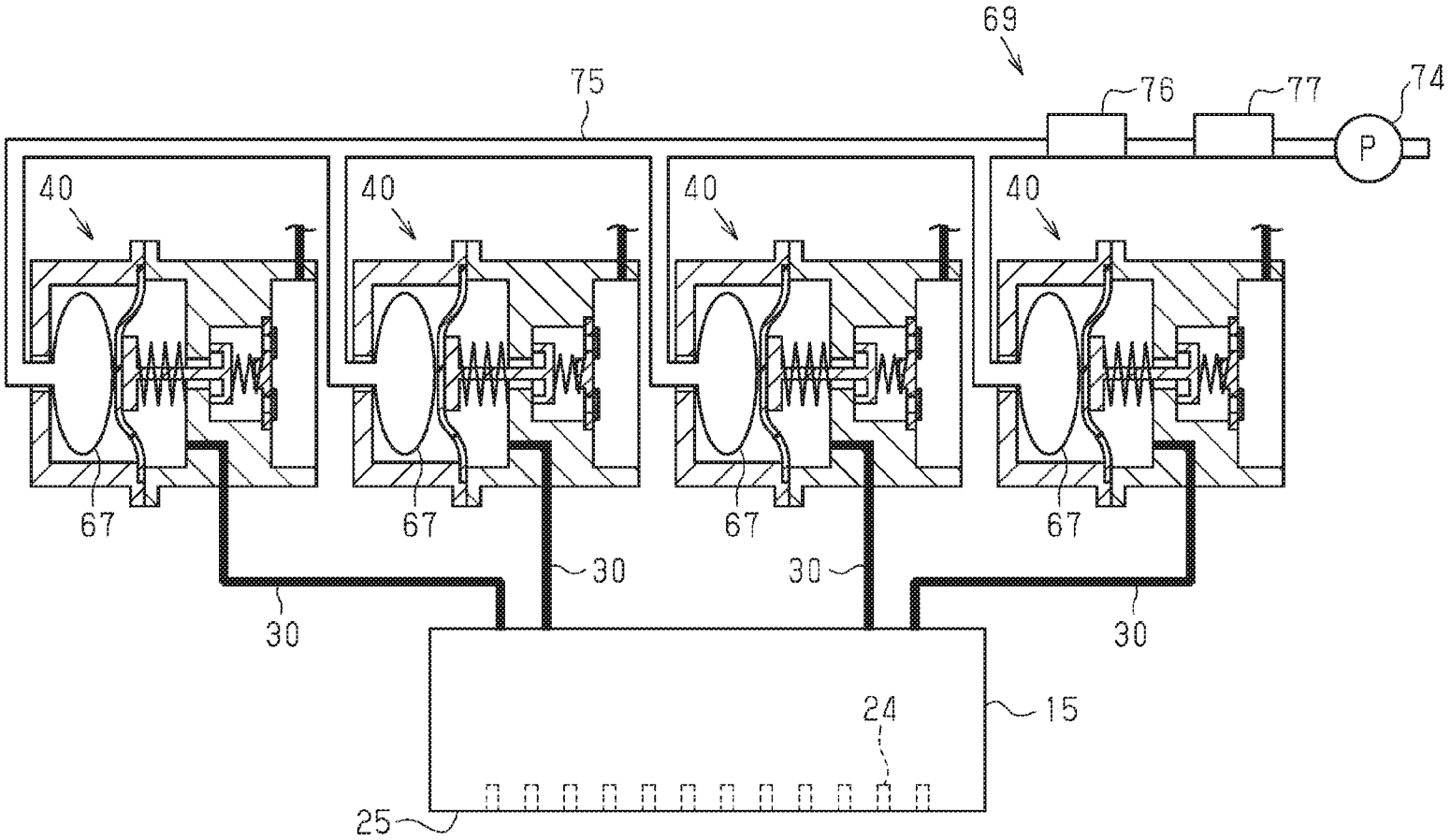
FIG. 3 is a sectional view schematically illustrating a plurality of pressure adjustment apparatuses and a pressure adjustment portion.

As illustrated in FIG. 3, the pressure adjustment portion 69 has a pressurizing pump 74 that pressurizes a fluid such as air and water, and a coupling path 75 that couples the pressurizing pump 74 and the expansion/contraction portion 67. The pressure adjustment portion 69 has a pressure detecting portion 76 that detects the pressure of the fluid inside the coupling path 75 and a fluid pressure adjustment portion 77 that adjusts the pressure of the fluid inside the coupling path 75.

The coupling path 75 is branched into a plurality of portions and is coupled to each of the expansion/contraction portions 67 of the plurality of pressure adjustment apparatuses 40 provided. The coupling path 75 of the present embodiment is branched into four and is coupled to each of the expansion/contraction portions 67 of the pressure adjustment apparatus 40 provided in four. The fluid pressurized by the pressurizing pump 74 is supplied to each of the expansion/contraction portions 67 via the coupling path 75. A valve that switches between opening and closing of the flow path may be provided at a portion of the coupling path 75 that is branched into a plurality of parts. By doing so, it becomes possible to selectively supply the pressurized fluid to the plurality of expansion/contraction portions 67 by controlling the valve.

The fluid pressure adjustment portion 77 is constituted with, for example, a relief valve. The fluid pressure adjustment portion 77 is configured to automatically open the valve when the pressure of the fluid inside the coupling path 75 becomes higher than a predetermined pressure. When the fluid pressure adjustment portion 77 opens the valve, the fluid inside the coupling path 75 is discharged to the outside. In this way, the fluid pressure adjustment portion 77 lowers the pressure of the fluid inside the coupling path 75.

As illustrated in FIG. 2, the liquid ejecting apparatus 11 may include a cap portion 79. The cap portion 79 may have a cap 80 capable of capping the nozzle surface 25 of the liquid ejecting portion 15, a cap opening valve 81 opening the inside of the cap 80 to the atmosphere, a suction pump 82 sucking the inside of the cap 80, and a waste liquid tank 83 storing a waste liquid.

The cap 80 moves relative to the liquid ejecting portion 15 to cap it. Capping is an operation that forms a space in which the nozzle 24 opens by the cap 80 contacting the liquid ejecting portion 15. The cap 80 caps the nozzle surface 25 to suppress the liquid inside the nozzle 24 from thickening due to drying.

The cap 80 may form a hermetically sealed space so that fluid such as gas and liquid does not flow the inside of the cap 80 and the outside of the cap 80 in a state in which the nozzle surface 25 is capped. By doing so, it is possible to further suppress the drying of the liquid inside the nozzle 24 by capping.

The cap opening valve 81 is a valve that can allow the inside of the cap 80 to communicate with the atmosphere outside the cap 80 by opening the valve in a state in which the cap 80 caps the liquid ejecting portion 15.

The cap portion 79 may have a plurality of caps 80 corresponding to the number of the liquid ejecting portions 15. The cap portion 79 of the present embodiment has the two caps 80. The two caps 80 cap the two liquid ejecting portions 15, respectively.

When driven in a state where the cap 80 has capped the liquid ejecting portion 15, the suction pump 82 applies a negative pressure to the nozzle 24 to forcibly discharge the liquid from the nozzle 24. The discharge of the liquid from the nozzle 24 is also referred to as suction cleaning. The waste liquid tank 83 stores the liquid discharged by suction cleaning as a waste liquid. The waste liquid tank 83 may be replaceable.

Next, the liquid ejecting portion 15 and the liquid return flow path 31 will be described.

As illustrated in FIG. 2, the liquid ejecting portion 15 has a filter 84 filtering the supplied liquid, and ejects the liquid filtered by the filter 84 from the nozzle 24. The filter 84 captures air bubbles, foreign matter, or the like in the supplied liquid. The filter 84 may be provided in a common liquid chamber 85 to which the liquid supply flow path 30 is coupled.

The liquid ejecting portion 15 includes a plurality of pressure chambers 86 that communicate with the common liquid chamber 85. A plurality of nozzles 24 are provided in communication with each of the plurality of pressure chambers 86. A portion of the wall surface of the pressure chamber 86 is formed by a vibration plate 87. The common liquid chamber 85 and the pressure chamber 86 communicate with each other via the supply side communication passage 88.

The liquid ejecting portion 15 includes a plurality of actuators 89 and a plurality of storage chambers 90 that store the actuators 89. The storage chamber 90 is disposed at a position different from the common liquid chamber 85. One storage chamber 90 stores one actuator 89. The actuator 89 is provided on the surface of the vibration plate 87 opposite to the part facing the pressure chamber 86.

The actuator 89 of the present embodiment is constituted with a piezoelectric element that contracts when a drive voltage is applied. When the vibration plate 87 is deformed in accordance with the contraction of the actuator 89 due to the application of the drive voltage, and then the application of the drive voltage to the actuator 89 is released, the liquid inside the pressure chamber 86 whose volume has changed becomes liquid droplets from the nozzle 24 is ejected. That is, the liquid ejecting portion 15 ejects the liquid from the nozzle 24 communicating with each pressure chamber 86 by pressurizing the liquid inside the pressure chamber 86 with the actuator 89.

Figure 4:
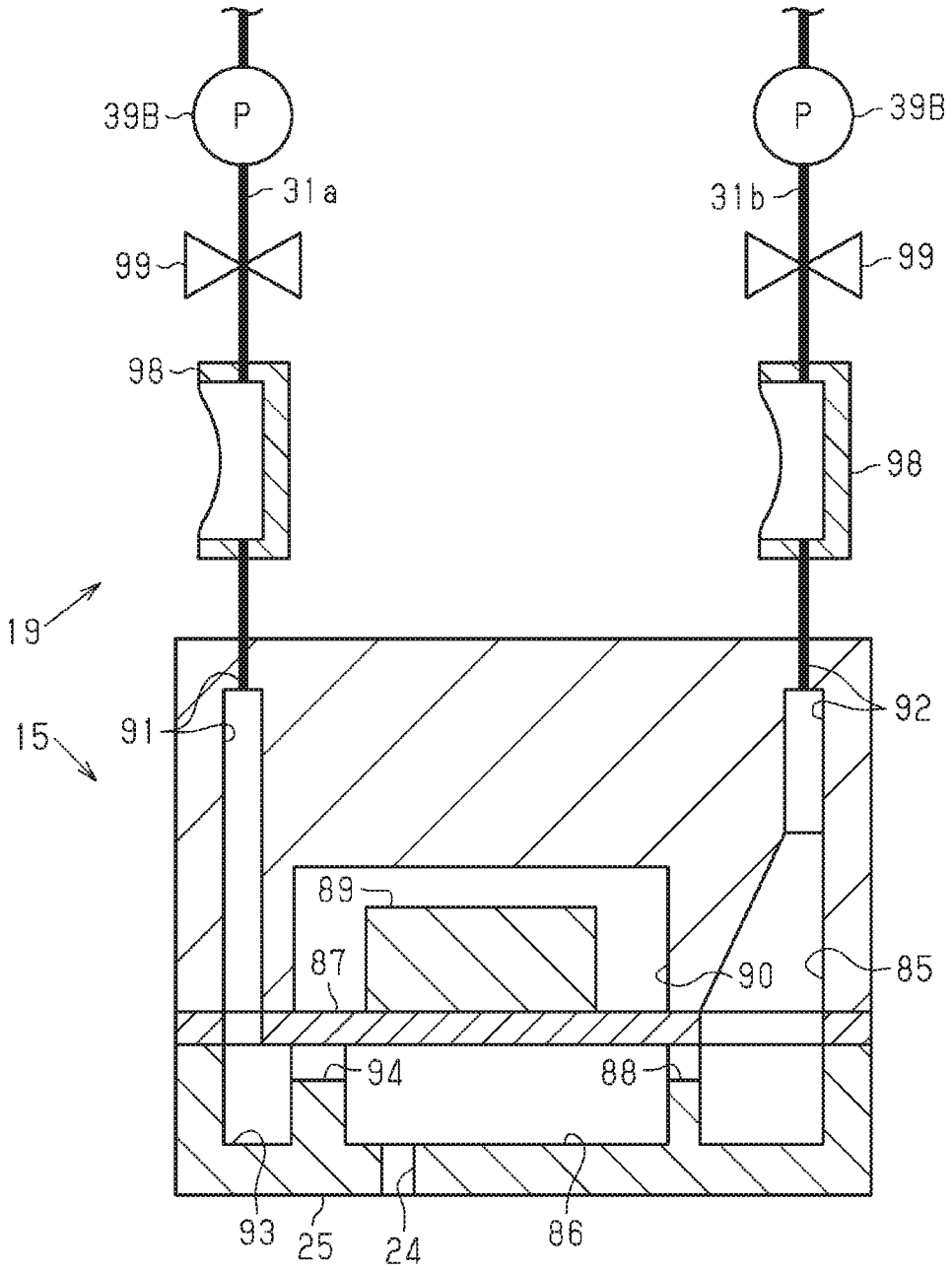
FIG. 4 is a sectional view taken along line IV-IV in FIG. 2.

As illustrated in FIG. 4, the liquid ejecting portion 15 may have a first discharge flow path 91 and a second discharge flow path 92 that discharge the supplied liquid to the outside without passing through the nozzle 24, and a discharge liquid chamber 93 that couples the first discharge flow path 91 and the pressure chamber 86. The discharge liquid chamber 93 communicates with the plurality of pressure chambers 86 via a discharge side communication passage 94 provided for each pressure chamber 86. By providing the discharge liquid chamber 93, only one first discharge flow path 91 is provided for the plurality of pressure chambers 86. That is, by providing the discharge liquid chamber 93, it is not necessary to provide the first discharge flow path 91 for each pressure chamber 86. Accordingly, the configuration of the liquid ejecting portion 15 can be simplified. The liquid ejecting portion 15 may have the plurality of first discharge flow paths 91 that communicate with the plurality of pressure chambers 86.

As illustrated in FIGS. 2 and 4, the liquid return flow path 31 may have a first return flow path 31*a* coupled to the first discharge flow path 91 and a second return flow path 31*b* coupled to the second discharge flow path 92. The liquid return flow path 31 of the present embodiment is configured so that the first return flow path 31*a* and the second return flow path 31*b* join together. In the liquid return flow path 31, the first return flow path 31*a* and the second return flow path 31*b* may not be joined together but may be coupled to the liquid supply flow path 30, respectively.

A damper 98 and the return valve 99 may be provided in the first return flow path 31*a* and the second return flow path 31*b*. The return pump 39B may be provided in each of the first return flow path 31*a* and the second return flow path 31*b*, or one in the liquid return flow path 31 between a portion at which the first return flow path 31*a* and the second return flow path 31*b* join and a coupling portion to the liquid supply flow path 30.

The damper 98 is configured to store the liquid. One surface of the damper 98 is formed of a flexible film, for example, and the volume storing the liquid is variable. By providing the damper 98, it is possible to suppress fluctuations in pressure occurring in the liquid ejecting portion 15 when the liquid flows through the first return flow path 31*a* and the second return flow path 31*b*.

In the first return flow path 31*a*, the return valve 99 is positioned between the return pump 39B and the damper 98. In the second return flow path 31*b*, the return valve 99 is positioned between the return pump 39B and the damper 98. The liquid supply portion 19 may cause the liquid to flow in any flow path of the first return flow path 31*a* and the second return flow path 31*b* by opening and closing the return valve 99. The liquid supply portion 19 may adjust the opening degree of the return valve 99. The flow rate of the liquid flowing through the first return flow path 31*a* and the second return flow path 31*b* is a flow rate according to the opening degree of the return valve 99.

Next, the electrical configuration of the liquid ejecting apparatus 11 will be described.

Figure 5:
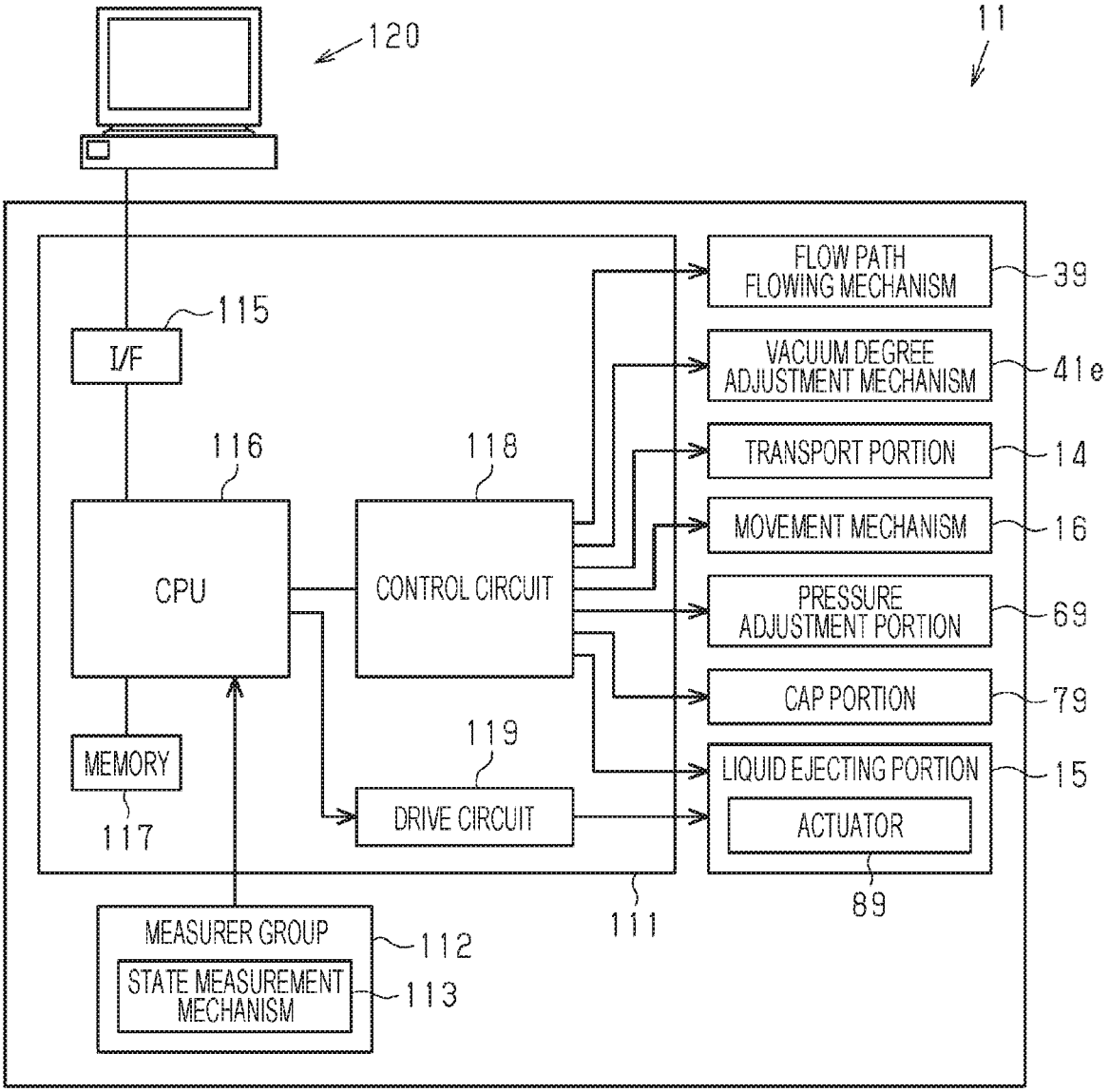
FIG. 5 is a block diagram illustrating an electrical configuration of the liquid ejecting apparatus.

As illustrated in FIG. 5, the liquid ejecting apparatus 11 includes a control portion 111 that integrally controls the constituent element of the liquid ejecting apparatus 11, and a detector group 112 that is controlled by the control portion 111. The detector group 112 includes a state detecting mechanism 113 capable of measuring the state inside the pressure chamber 86 by measuring the vibration waveform of the pressure chamber 86. The detector group 112 monitors the situation inside the liquid ejecting apparatus 11. The detector group 112 outputs the detecting result to the control portion 111.

The control portion 111 has an interface portion 115, a CPU 116, a memory 117, a control circuit 118, and a drive circuit 119. The interface portion 115 transmits and receives data between the computer 120, which is an external apparatus, and the liquid ejecting apparatus 11. The drive circuit 119 generates a drive signal driving the actuator 89.

The CPU 116 is an arithmetic processing apparatus. The memory 117 is a storage device that secures an area for storing a program of the CPU 116, a work area, or the like, and has a storage element such as a RAM and an EEPROM. The CPU 116 controls each mechanism of the liquid ejecting apparatus 11 via the control circuit 118 according to the program stored in the memory 117.

The detector group 112 may include, for example, a linear encoder that detects the movement situation of the carriage 27, and a medium detecting sensor that detects the medium 12. The state detecting mechanism 113 may be a circuit that detects residual vibration of the pressure chamber 86. The control portion 111 performs a nozzle inspection described later based on the detecting result of the state detecting mechanism 113. The state detecting mechanism 113 may include a piezoelectric element that constitutes the actuator 89.

Next, the nozzle inspection will be described.

When a voltage is applied to the actuator 89 by a signal from the drive circuit 119, the vibration plate 87 is flexibly deformed. Accordingly, pressure fluctuations in the pressure chamber 86 occur. Due to this fluctuation, the vibration plate 87 vibrates for a while. This vibration is called residual vibration. Measuring the state of the pressure chamber 86 and the nozzle 24 communicating with the pressure chamber 86 from the state of the residual vibration is called a nozzle inspection.

Figure 6:
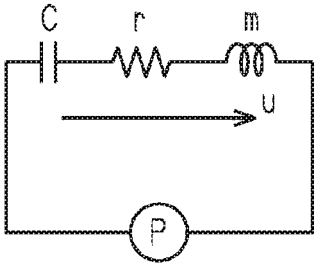
FIG. 6 is a view illustrating a calculation model of simple vibration assuming residual vibration of a vibration plate.

FIG. 6 is a diagram illustrating a calculation model of simple vibration assuming the residual vibration of the vibration plate 87.

When the drive circuit 119 applies a drive signal to the actuator 89, the actuator 89 expands and contracts according to the voltage of the drive signal. The vibration plate 87 flexes according to the expansion and contraction of the actuator 89. Accordingly, the volume of the pressure chamber 86 expands and then contracts. At this time, part of the liquid filling the pressure chamber 86 is ejected from the nozzle 24 as liquid droplets by the pressure generated in the pressure chamber 86.

During the series of operations of the vibration plate 87 described above, the vibration plate 87 freely vibrates at the natural vibration frequency determined by the shape of the flow path in which the liquid flows, a flow path resistance r due to the viscosity of the liquid or the like, an inertance m due to the weight of the liquid inside the flow path, and a compliance C of the vibration plate 87. The free vibration of the vibration plate 87 is the residual vibration.

Figure 7:
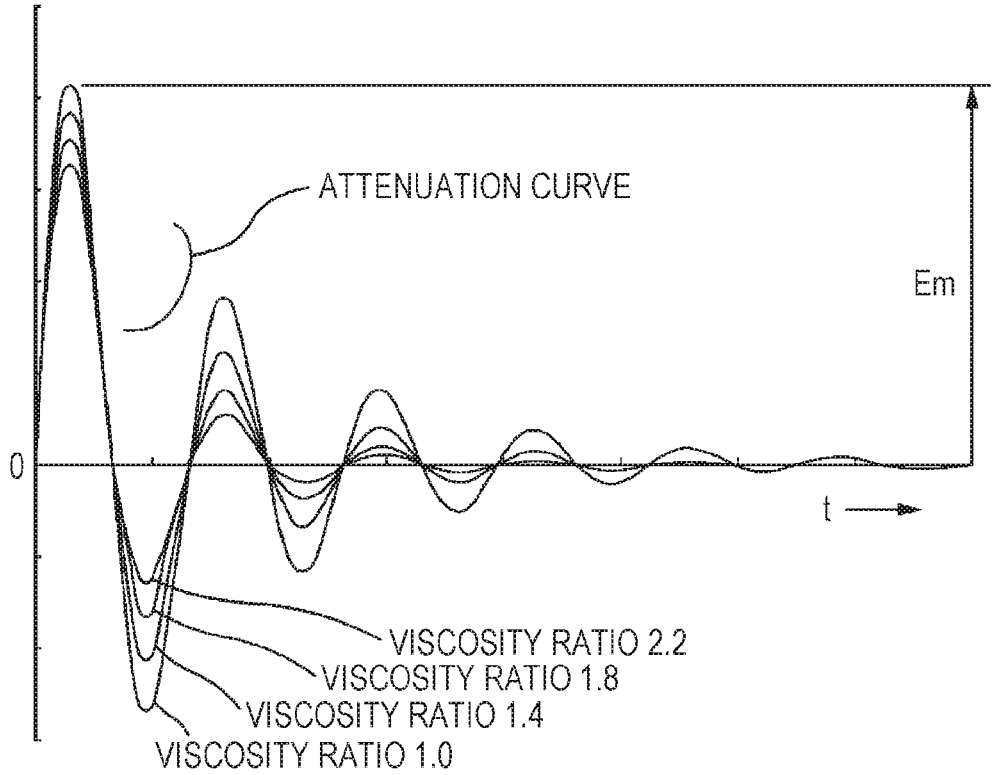
FIG. 7 is an explanatory diagram illustrating the relationship between the thickening of a liquid and a residual vibration waveform.

The calculation model of the residual vibration of the vibration plate 87 illustrated in FIG. 7 can be expressed by a pressure P and the inertance m, the compliance C, and the flow path resistance r described above. When the step response when the pressure P is applied to the circuit of FIG. 6 is calculated for a volume velocity u, the following equation is obtained.

Equation 1

FIG. 7 is an explanatory diagram of the relationship between the thickening of the liquid and the residual vibration waveform. The horizontal axis of FIG. 7 represents time, and the vertical axis represents the magnitude of the residual vibration. For example, when the liquid at the vicinity of the nozzle 24 is dried, the viscosity of the liquid increases, that is, thickens. When the liquid thickens, the flow path resistance r increases, so that the vibration period and the attenuation of the residual vibration increase.

Figure 8:
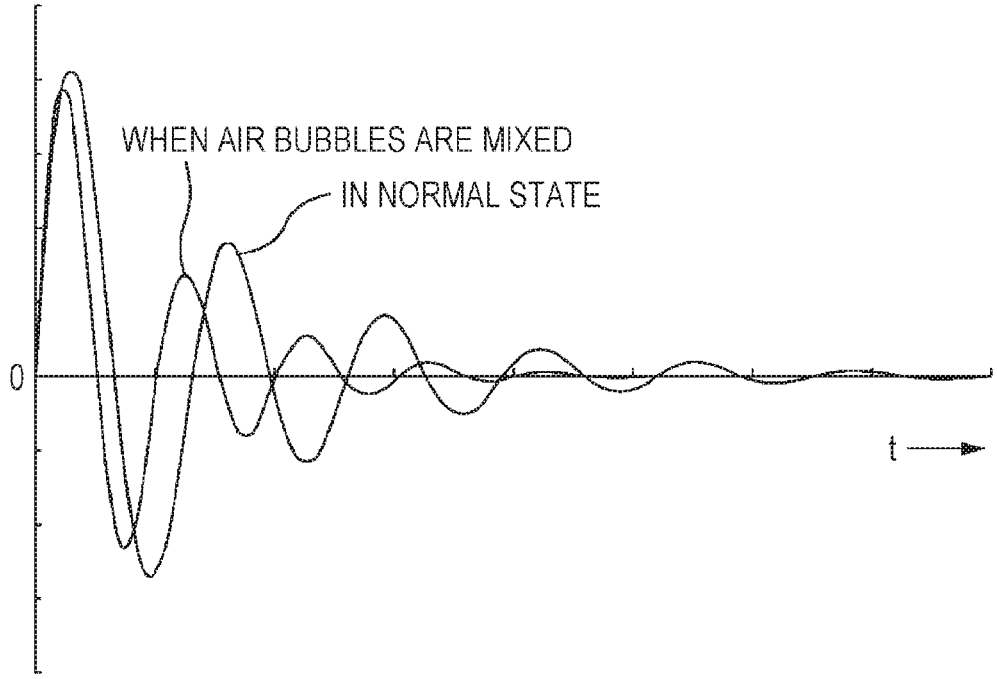
FIG. 8 is an explanatory diagram illustrating a relationship between air bubble mixing and a residual vibration waveform.

FIG. 8 is an explanatory diagram of the relationship between air bubble mixing and the residual vibration waveform. The horizontal axis of FIG. 8 represents time, and the vertical axis represents the magnitude of the residual vibration. For example, when the air bubbles are mixed in the liquid flow path or the tip end of the nozzle 24, the inertance m, which is the liquid weight, is reduced by the amount of the air bubbles mixed in compared to when the state of the nozzle 24 is normal. According to Equation (2), when the m decreases, an angular velocity ω increases, so that the vibration period becomes shorter. That is, the vibration frequency becomes high.

In addition, when foreign matter such as paper dust adheres to the vicinity of the opening of the nozzle 24, it is considered that the inertance m increases because the amount of the liquid inside the pressure chamber 86 and the exuding portion as viewed from the vibration plate 87 increases more than in the normal state. It is considered that the flow path resistance r is increased by the fibers of the paper dust attached to the vicinity of the outlet of the nozzle 24. Accordingly, when the paper dust adheres to the vicinity of the opening of the nozzle 24, the frequency is lower than that during normal ejection, and the frequency of the residual vibration is higher than that when the liquid is thickened.

When the thickening of the liquid, the mixing of air bubbles, or the sticking of foreign matter occur, the state inside the nozzle 24 and the pressure chamber 86 becomes abnormal, so that the liquid is typically not ejected from the nozzle 24. Accordingly, missing dots occur in the image recorded on the medium 12. Although the liquid droplet is ejected from the nozzle 24, the amount of the liquid droplet may be small, or the flight direction of the liquid droplet may be deviated and may not land at a target position. The nozzle 24 with such ejection failure occurring is called an abnormal nozzle.

As described above, the residual vibration of the pressure chamber 86 communicating with the abnormal nozzle is different from the residual vibration of the pressure chamber 86 communicating with the normal nozzle 24. Accordingly, the state detecting mechanism 113 detects the state inside the pressure chamber 86 by measuring the vibration waveform of the pressure chamber 86. The control portion 111 performs the inspection of the nozzle 24 based on the detecting result of the state detecting mechanism 113.

The control portion 111 may estimate whether the ejection state of the liquid ejecting portion 15 is normal or abnormal based on the vibration waveform of the pressure chamber 86 that is the detecting result of the state detecting mechanism 113. When the state inside the pressure chamber 86 is abnormal, the nozzle 24 communicating with the pressure chamber 86 is estimated to be an abnormal nozzle. The control portion 111 may estimate, based on the vibration waveform of the pressure chamber 86, whether the state inside the pressure chamber 86 is abnormal due to the presence of air bubbles or the state inside the pressure chamber 86 is abnormal due to thickening of the liquid. Based on the vibration waveform of the pressure chamber 86, the control portion 111 may estimate the total volume of air bubbles existing in the pressure chamber 86 and the nozzle 24 communicating with the pressure chamber 86, and the degree of thickening of the liquid of the pressure chamber 86 and the nozzle 24 communicating with the pressure chamber 86.

The frequency of the vibration waveform detected in the state where air bubbles are present in the pressure chamber 86 and the nozzle 24 that are filled with the liquid is higher than the frequency of the vibration waveform detected in the state where no air bubbles are present in the pressure chamber 86 and the nozzle 24 that are filled with the liquid. The frequency of the vibration waveform detected in the state where the pressure chamber 86 and the nozzle 24 are filled with air is higher than the frequency of the vibration waveform detected in the state where air bubbles are present in the pressure chamber 86 and the nozzle 24 that are filled with the liquid. The air bubbles existing in the pressure chamber 86 and the nozzle 24 that are filled with the liquid become larger as they grow. The larger the size of the air bubbles present in the pressure chamber 86 and the nozzle 24 that are filled with the liquid, the higher the frequency of the vibration waveform.

In the liquid ejecting apparatus 11, when the flow of the liquid is stagnant, the liquid is likely to thicken or air bubbles are likely to be accumulated. In this case, abnormal nozzles are likely to occur. That is, the state inside the pressure chamber 86 is likely to become abnormal. Accordingly, the control portion 111 performs a maintenance operation maintaining the liquid ejecting portion 15 for the purpose of suppressing the thickening of the liquid in the liquid ejecting portion 15 and discharging the air bubbles. The control portion 111 drives and controls the vacuum degree adjustment mechanism 41*e* based on the detecting result of the state detecting mechanism 113. The control portion 111 of the present embodiment is configured to perform a first operation, a second operation, a third operation, and a fourth operation as the maintenance operation of the liquid ejecting portion 15.

Among the plurality of nozzles 24 in the liquid ejecting portion 15 during the recording processing, a non-ejecting nozzle that does not eject the liquid because it is not used for recording and an ejecting nozzle that ejects the liquid because it is used for recording may appear. In this case, in the ejecting nozzle and the pressure chamber 86 communicating with the ejecting nozzle, since the liquid is ejected from the nozzle 24, it is difficult that the generation of air bubbles and the growth of air bubbles occur in the liquid, and it is difficult for the liquid to thicken. In the non-ejecting nozzle and the pressure chamber 86 communicating with the non-ejecting nozzle, the liquid is stagnant because the liquid is not ejected from the nozzle 24. Accordingly, in the pressure chamber 86 that communicates with the non-ejecting nozzle, as compared with the pressure chamber 86 that communicates with the ejecting nozzle, the generation of air bubbles and the growth of air bubbles are likely to occur in the liquid, and the liquid is likely to thicken. The control portion 111 may target the pressure chamber 86 communicating with the non-ejecting nozzle and perform the state detection by the state detecting mechanism 113 when the non-ejecting nozzle that does not eject the liquid and the ejecting nozzle that ejects the liquid are included in the plurality of nozzles 24.

To suppress the thickening of the liquid, it is common to perform flushing. When liquid droplets are not ejected from the nozzles 24 during the recording processing, that is, when the carriage 27 returns or when flushing is performed between pages of the medium 12, it is possible to suppress the generation of air bubbles and the growth of air bubbles or thickening in the liquid inside the liquid ejecting portion 15. When flushing is performed, liquid droplets are ejected from the nozzle 24, so that liquid is consumed. If the flushing is performed step by step to suppress the generation of air bubbles and the growth of air bubbles or thickening in the liquid during the recording processing, the liquid consumption is large. When the first operation, the second operation, the third operation, and the fourth operation in the present embodiment is performed, the frequency of ejecting liquid droplets from the nozzle 24 for maintenance can be reduced. Accordingly, consumption of liquid due to maintenance can be reduced.

The control portion 111 may perform the first operation of driving the vacuum degree adjustment mechanism 41*e* to increase the vacuum degree of the degas module 41 as the maintenance operation of the liquid ejecting portion 15. The control portion 111 may increase the vacuum degree the degas module 41 by setting the vacuum degree of the degas module 41 to a first vacuum degree V1 higher than a reference vacuum degree Vs. Based on the detecting result of the state detecting mechanism 113, the control portion 111 may perform the first operation when the generation of air bubbles and the growth of air bubbles are estimated because the air bubbles existing in the pressure chamber 86 have a volume equal to or larger than the first set value. The first set value is stored in the memory 117 of the control portion 111. The memory 117 may store, for example, the frequency of the vibration waveform detected by the state detecting mechanism 113 when the air bubbles existing in the pressure chamber 86 have a volume that is the first set value.

The air bubbles may dissolve in the liquid over time and disappear when the volume thereof existing in the pressure chamber 86 is small. Further, the air bubbles existing in the pressure chamber 86 are dissolved in the liquid over time when the liquid contacting the air bubbles is flowing, and easily disappear, as compared with when the liquid contacting the air bubbles is stagnant. When the volume of the air bubbles is small, the air bubbles can be removed from the pressure chamber 86 without performing the first operation by, for example, waiting for a predetermined time. On the contrary, there is a concern that the air bubbles existing in the pressure chamber 86 may grow over time when the volume is large. Accordingly, the first set value is a value indicating the minimum volume of the air bubbles in which the disappearance of air bubbles is not expected over time.

The control portion 111 may perform the second operation of driving the flow path flowing mechanism 39 in addition to the first operation of controlling the vacuum degree adjustment mechanism 41*e*. That is, when the generation of the air bubbles and the growth of the air bubbles are estimated from the detecting result of the state detecting mechanism 113, the control portion 111 may perform the second operation of driving the flow path flowing mechanism 39 in a state where the first operation of adjusting the vacuum degree of the degas module 41 has been performed.

In the second operation, the control portion 111 may discharge the liquid toward the liquid return flow path 31 by sucking the liquid inside the pressure chamber 86 from the side of the liquid return flow path 31 so that the meniscus at the gas-liquid interface inside the nozzle 24 is maintained. In the second operation, the control portion 111 may discharge the liquid toward the liquid return flow path 31 by pressurizing the liquid inside the pressure chamber 86 from the side of the liquid supply flow path 30. When the second operation is performed, the pressure inside the pressure chamber 86 fluctuates, so that the meniscus moves. The control portion 111 may perform the second operation so that the movement of the meniscus is contained within the nozzle 24. When the meniscus moves to approach the pressure chamber 86, the liquid inside the nozzle 24 returns to the pressure chamber 86, so that it is also possible to flow the liquid positioned inside the nozzle 24.

Based on the detecting result of the state detecting mechanism 113, when the viscosity increase of the liquid is estimated due to the fact that the liquid in the pressure chamber 86 has a viscosity equal to or higher than the second set value, the control portion 111 may perform the third operation as the maintenance operation of the liquid ejecting portion 15. The second set value is stored in the memory 117 of the control portion 111. The memory 117 may store, for example, the frequency of the vibration waveform detected by the state detecting mechanism 113 when the viscosity of the liquid existing in the pressure chamber 86 is the second set value. The third operation is an operation of driving the flow path flowing mechanism 39 in a state where the vacuum degree of the degas module 41 has been adjusted, to increase the flow rate of the liquid flowing in the liquid supply flow path 30 and the liquid return flow path 31. The flow rate of the liquid is the volume of liquid flowing per unit time. In the third operation, the control portion 111 may increase the flow rate of the liquid flowing inside the liquid supply flow path 30 and inside the liquid return flow path 31 by the predetermined flow rate Fα. For example, when the flow rate of the liquid is set to be a flow rate larger than a reference flow rate Fs by the predetermined flow rate Fα, the predetermined flow rate Fα is a value at which the flow rate of the liquid is smaller than the maximum flow rate that can be set by the flow path flowing mechanism 39. In the third operation, the control portion 111 may increase the flow rate of the liquid flowing through the first return flow path 31*a* and the second return flow path 31*b* by increasing the opening degree of the return valve 99.

The control portion 111 may perform the fourth operation of driving the vacuum degree adjustment mechanism 41*e* in addition to the third operation of driving the flow path flowing mechanism 39. The fourth operation is an operation of driving the vacuum degree adjustment mechanism 41*e* to lower the vacuum degree of the degas module 41. In the fourth operation, the control portion 111 may set the vacuum degree of the degas module 41 to a second vacuum degree V2 which is lower than the reference vacuum degree Vs, thereby lowering the vacuum degree of the degas module 41.

Next, a maintenance method of the liquid ejecting apparatus 11 will be described.

Figure 9:
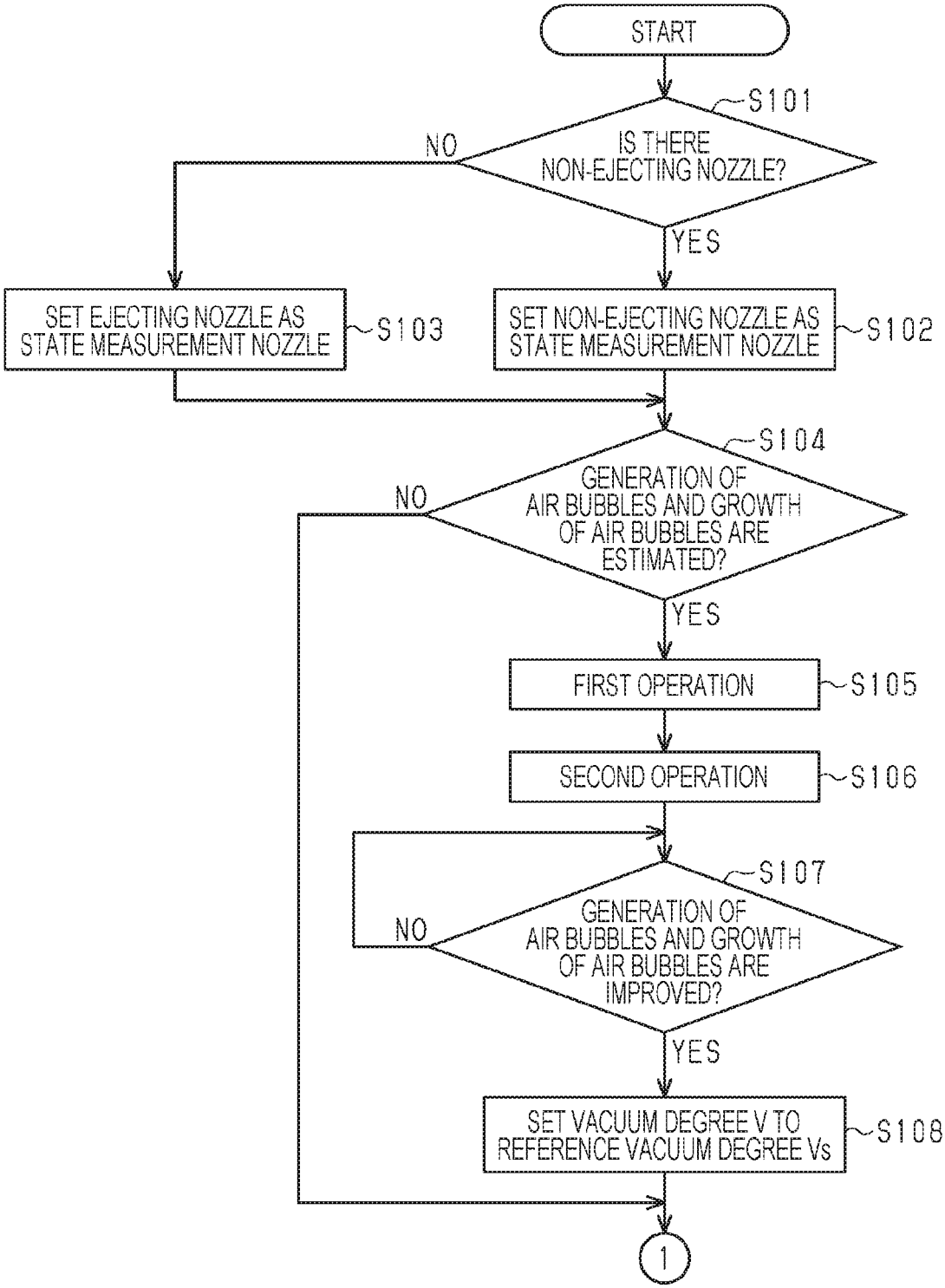
FIG. 9 is a flowchart illustrating a routine of maintenance processing.
Figure 10:
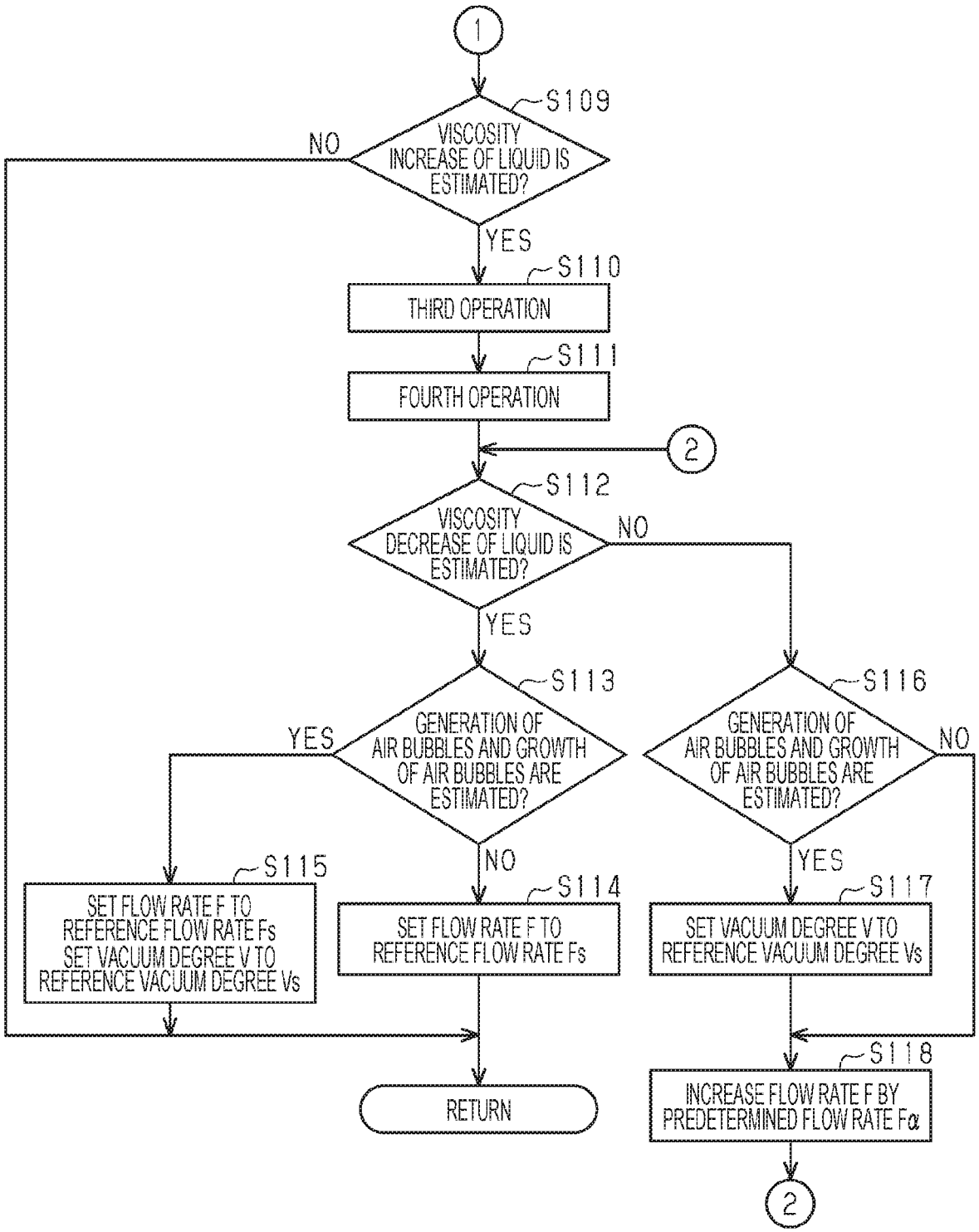
FIG. 10 is a flowchart illustrating a routine of maintenance processing.

The routine of the maintenance processing illustrated in FIGS. 9 and 10 is repeatedly performed at predetermined intervals when the liquid ejecting portion 15 performs the recording processing. In the middle of performing the routine of the maintenance processing, the degassing processing of the degas module 41 by the vacuum degree adjustment mechanism 41*e* and the flow processing of the liquid by the flow path flowing mechanism 39 may be continuously performed.

When the routine of the maintenance processing is performed for the first time, the vacuum degree adjustment mechanism 41*e* adjusts the vacuum degree of the degas module 41 to the reference vacuum degree Vs. When the routine of the maintenance processing is performed for the first time, the flow rate of the liquid inside the liquid supply flow path 30 and inside the liquid return flow path 31 is adjusted to the reference flow rate Fs by the flow path flowing mechanism 39. In the following description, the vacuum degree of the degas module 41 adjusted by the vacuum degree adjustment mechanism 41*e* is referred to as the vacuum degree V, and the flow rate of the liquid inside the liquid supply flow path 30 and inside the liquid return flow path 31 adjusted by the flow path flowing mechanism 39 is referred to as the flow rate F.

As illustrated in FIG. 9, in a step S101, the control portion 111 determines whether or not there is a non-ejecting nozzle in the nozzle 24 that does not eject the liquid. If there is the non-ejecting nozzle in the step S101, the step S101 becomes YES. The control portion 111 shifts the processing to a step S102. If there is no non-ejecting nozzle, the step S101 becomes NO, and the control portion 111 shifts the processing to a step S103.

In the step S102, the control portion 111 sets the non-ejecting nozzle as the state detection nozzle. In the step S103, the control portion 111 sets the ejecting nozzle as the state detection nozzle. That is, the control portion 111 performs the detection of the state of the pressure chamber 86 by the state detecting mechanism 113 for the nozzle 24 set as the state detection nozzle in the step S102 or the step S103. After performing the processing of the step S102 or the step S103, the control portion 111 shifts the processing to a step S104.

In the step S104, the control portion 111 determines whether or not the generation of air bubbles and the growth of air bubbles are estimated based on the detecting result by the state detecting mechanism 113. When the generation of air bubbles and the growth of air bubbles are estimated in the step S104, the step S104 becomes YES. The control portion 111 shifts the processing to a step S105. When the generation of air bubbles and the growth of air bubbles are not estimated, the step S104 becomes NO, and the control portion 111 shifts the processing to a step S109 illustrated in FIG. 10.

In the step S105, the control portion 111 performs the first operation. In the first operation, the vacuum degree V is set to the first vacuum degree V1 that is higher than the reference vacuum degree Vs. After performing the processing of the step S105, the control portion 111 shifts the processing to a step S106. In the step S106, the control portion 111 performs the second operation. The flow rate F in the second operation in the step S106 is the reference flow rate Fs. After performing the processing of the step S106, the control portion 111 shifts the processing to a step S107.

In the step S107, the control portion 111 determines whether or not the generation of air bubbles and the growth of air bubbles have been improved based on the detecting result by the state detecting mechanism 113. When it is determined in the step S107 that the generation of air bubbles and the growth of air bubbles have been improved, the step S107 becomes YES. The control portion 111 shifts the processing to a step S108. When it is determined that the generation of air bubbles and the growth of air bubbles have not been improved, the step S107 becomes NO, and the control portion 111 performs the step S107 again. The control portion 111 repeatedly performs the step S107 until the step S107 becomes YES. In the step S108, the control portion 111 sets the vacuum degree V to the reference vacuum degree Vs. The control portion 111 shifts the processing to the step S109 illustrated in FIG. 10.

In the step S109, the control portion 111 determines whether or not the viscosity increase of the liquid is estimated based on the detecting result by the state detecting mechanism 113. When the viscosity increase of the liquid is estimated in the step S109, the step S109 becomes YES. The control portion 111 shifts the processing to a step S110. If the viscosity increase of the liquid is not estimated, the step S109 becomes NO and the routine of the maintenance processing is temporarily ended.

In the step S110, the control portion 111 performs the third operation. In the third operation, the flow rate F is increased by the predetermined flow rate Fa. After performing the processing of the step S110, the control portion 111 shifts the processing to a step S111. In the step S111, the control portion 111 performs the fourth operation. In the fourth operation, the vacuum degree V is set to the second vacuum degree V2 which is lower than the reference vacuum degree Vs. The control portion 111 shifts the processing to a step S112.

In the step S112, the control portion 111 determines whether or not the viscosity decrease of the liquid is estimated based on the detecting result by the state detecting mechanism 113. When it is determined in the step S112 that the viscosity decrease of the liquid is estimated, the step S112 becomes YES. The control portion 111 shifts the processing to a step S113. When it is determined in the step S112 that the viscosity decrease in the liquid is not estimated, the step S112 becomes NO. The control portion 111 shifts the processing to a step S116.

In the step S113, the control portion 111 determines whether or not the generation of air bubbles and the growth of air bubbles are estimated based on the detecting result by the state detecting mechanism 113. When it is determined that the generation of air bubbles and the growth of air bubbles are not estimated, the step S113 becomes NO. The control portion 111 shifts the processing to a step S114. When it is determined in the step S113 that the generation of air bubbles and the growth of air bubbles are estimated, the step S113 becomes YES. The control portion 111 shifts the processing to a step S115.

In the step S114, the control portion 111 sets the flow rate F to the reference flow rate Fs. After performing the processing of the step S114, the control portion 111 temporarily ends the routine of the maintenance processing. In the step S115, the control portion 111 sets the flow rate F to the reference flow rate Fs and the vacuum degree V to the reference vacuum degree Vs. The control portion 111 temporarily ends the routine of the maintenance processing.

In the step S116, the control portion 111 determines whether or not the generation of air bubbles and the growth of air bubbles are estimated based on the detecting result by the state detecting mechanism 113. When it is determined in the step S116 that the generation of air bubbles and the growth of air bubbles are not estimated, the step S116 becomes NO. The control portion 111 shifts the processing to a step S118. When it is determined in the step S116 that the generation of air bubbles and the growth of air bubbles are estimated, the step S116 becomes YES. The control portion 111 shifts the processing to a step S117.

In the step S117, the control portion 111 sets the vacuum degree V to the reference vacuum degree Vs. The control portion 111 shifts the processing to the step S118. In the step S118, the control portion 111 increases the flow rate F by the predetermined flow rate Fa. The control portion 111 performs the step S112 again.

The operation of the present embodiment will be described.

When the step S104 becomes YES, the generation of air bubbles and the growth of air bubbles can be estimated, and it is a time necessary to increase the vacuum degree V. In this case, the control portion 111 may increase the vacuum degree V to the first vacuum degree V1 that is higher than the reference vacuum degree Vs by performing the first operation in the step S105. When the control portion 111 performs the first operation, the degassing degree of the liquid inside the degassing chamber 41*a* is increased by the degas module 41. The liquid whose the degassing degree is adjusted to a high level is supplied from the inside of the degassing chamber 41*a* to the pressure chamber 86 via the liquid supply flow path 30 and the pressure adjustment apparatus 40. Accordingly, this improves the generation of air bubbles and the growth of air bubbles in the liquid inside the pressure chamber 86 and the liquid in the nozzle 24 communicating with the pressure chamber 86.

When the step S104 becomes NO, the generation of air bubbles and the growth of air bubbles are not estimated, and it is a time not necessary to increase the vacuum degree V. In this case, the control portion 111 may shift to the processing of determining the viscosity increase of the liquid by shifting to the step S109 without changing the vacuum degree V.

The control portion 111 may perform the second operation in the step S106. In the second operation in the step S106, the liquid inside the liquid supply flow path 30 and inside the liquid return flow path 31 may be driven to flow in a state where the vacuum degree V is adjusted by the first operation in the step S105. When the flow path flowing mechanism 39 is driven and the liquid inside the liquid supply flow path 30 and inside the liquid return flow path 31 is already flowing at a time of performing the processing of the step S106, the control portion 111 may continuously drive the flow path flowing mechanism 39 in the step S106. When the flow path flowing mechanism 39 is not driven at a time of performing the processing of the step S106, the control portion 111 may start the flowing drive of the liquid by the flow path flowing mechanism 39 in the step S106.

When the control portion 111 performs the second operation, the liquid inside the liquid supply flow path 30 and inside the liquid return flow path 31 flows by the flow path flowing mechanism 39. That is, the control portion 111 sends the liquid having a low degassing degree inside the nozzle 24 of the liquid ejecting portion 15 and inside the pressure chamber 86, to the degas module 41 via the liquid return flow path 31, the liquid storing portion 32, and the liquid supply flow path 30, and returns the liquid degassed by the degas module 41 to the pressure chamber 86 of the liquid ejecting portion 15. Accordingly, the generation of air bubbles and the growth of air bubbles in the nozzle 24 and the pressure chamber 86 can be suppressed.

When the step S107 becomes NO, the generation of air bubbles and the growth of air bubbles are not improved, and it is a time necessary to maintain the vacuum degree V at a high level. In this case, the control portion 111 repeatedly performs the step S107 and may continue the processing to improve the generation of air bubbles and the growth of air bubbles by the first operation and the second operation until the generation of air bubbles and the growth of air bubbles are improved.

When the step S107 becomes YES, the generation of air bubbles and the growth of air bubbles are improved, and it is not a time necessary to maintain the vacuum degree V at a high level. In this case, the control portion 111 may set the vacuum degree V to the reference vacuum degree Vs in the step S108. Accordingly, the vacuum degree V set to the first vacuum degree V1 that is higher than the reference vacuum degree Vs by the first operation in the step S105, is lowered to the reference vacuum degree Vs.

When the step S109 becomes NO, the viscosity increase of the liquid is not estimated and it is not a time necessary to increase the flow rate F. In this case, the control portion 111 may temporarily end the routine of the maintenance processing without changing the flow rate F.

When the step S109 becomes YES, the viscosity increase of the liquid can be estimated and it is a time necessary to increase the flow rate F. In this case, the control portion 111 may increase the flow rate F by the predetermined flow rate Fa by performing the third operation in the step S110. When the control portion 111 performs the third operation, the flow rate of the liquid moving from the inside of the nozzle 24 and the pressure chamber 86 toward the liquid return flow path 31 increases, so that the viscosity increase inside the nozzle 24 and the pressure chamber 86 is eliminated.

When the processing proceeds to the step S111, it is determined that the generation of air bubbles and the growth of air bubbles are not estimated in the step S104, or it is determined that the generation of air bubbles and the growth of air bubbles are improved in the step S107. Accordingly, at the time of performing the processing of the step S111, it is highly possible that neither the generation of air bubbles nor the growth of air bubbles occur in the liquid. When the viscosity increase of the liquid is estimated from the detecting result of the state detecting mechanism 113, the control portion 111 may perform the fourth operation of lowering the vacuum degree V in the step S104 in addition to the third operation in the step S110.

The air bubbles inside the pressure chamber 86 may be improved by increasing the flow rate of the liquid inside the liquid supply flow path 30 and inside the liquid return flow path 31. That is, by performing the third operation, it can be expected that not only the viscosity increase of the liquid is eliminated but also the generation of air bubbles and the growth of air bubbles in the liquid are suppressed. Accordingly, when performing the third operation, although the vacuum degree is lowered by the degas module 41, the generation of air bubbles and the growth of air bubbles in the liquid are less likely to occur. In the present embodiment, by performing the fourth operation when the third operation is performed, it is possible to suppress the generation of air bubbles by utilizing the flow of the liquid inside the liquid supply flow path 30 and the liquid return flow path 31 by the third operation.

When the step S112 becomes YES, the viscosity decrease in the liquid is estimated, and the processing to increase the flow rate F to lower the viscosity of the liquid is not necessary. In this case, the control portion 111 may set the flow rate F to the reference flow rate Fs in the step S114 or the step S115. Accordingly, in the step S110, the flow rate F increased to be higher than the reference flow rate Fs by the third operation is reduced to the reference flow rate Fs.

When the step S113 becomes NO, the generation of air bubbles and the growth of air bubbles are not estimated, and it is not a time necessary to increase the vacuum degree V. In this case, the control portion 111 may not have to change the vacuum degree V in the step S114 after the step S113.

When the step S113 becomes YES, the generation of air bubbles and the growth of air bubbles can be estimated, and it is a time necessary to increase the vacuum degree V. In this case, the control portion 111 sets the vacuum degree V to the reference vacuum degree Vs in the step S115. Accordingly, in the step S111, the vacuum degree V set to the second vacuum degree V2 lower than the reference vacuum degree Vs by the fourth operation is increased to the reference vacuum degree Vs. By increasing the vacuum degree V, the generation of air bubbles and the growth of air bubbles in the liquid can be improved.

When the step S112 becomes NO, the viscosity decrease of the liquid is not estimated, and it is a time necessary to further increase the flow rate F to lower the viscosity of the liquid. In this case, the control portion 111 may increase the flow rate F by the predetermined flow rate Fa in the step S118. Accordingly, in the step S110, the flow rate F is set to be higher than the flow rate F set by the third operation.

When the step S116 becomes NO, the generation of air bubbles and the growth of air bubbles are not estimated, and it is not a time necessary to increase the vacuum degree V. In this case, the vacuum degree V is not changed in the step S118 after the step S116.

When the step S116 becomes YES, the generation of air bubbles and the growth of air bubbles can be estimated, and it is a time necessary to increase the vacuum degree V. In this case, the control portion 111 may set the vacuum degree V to the reference vacuum degree Vs in the step S117. Accordingly, in the step S111, the vacuum degree V set to the second vacuum degree V2 lower than the reference vacuum degree Vs by the fourth operation is increased to the reference vacuum degree Vs. By increasing the vacuum degree V, the generation of air bubbles and the growth of air bubbles in the liquid can be improved.

The effects of the present embodiment will be described.

1. The control portion 111 drives and controls the vacuum degree adjustment mechanism 41*e* based on the detecting result of the state detecting mechanism 113. Accordingly, compared with the case of using the vacuum degree adjustment mechanism 41*e* that maintains a state in which the control of the vacuum degree is not performed and the vacuum degree is high, the functional deterioration of the vacuum degree adjustment mechanism 41*e* can be reduced.

2. When the air bubbles generated in the pressure chamber 86 grow, the ejection performance of ejecting the liquid from the nozzle 24 may be deteriorated. In this respect, the control portion 111 increases the vacuum degree of the degas module 41 when the generation of air bubbles and the growth of air bubbles are estimated, so that the functional deterioration of the vacuum degree adjustment mechanism 41*e* can be reduced while suppressing the deterioration of the ejection performance due to the growth of air bubbles.

3. The control portion 111 causes the liquid inside the liquid supply flow path 30 and the liquid return flow path 31 to flow by the flow path flowing mechanism 39. That is, the control portion 111 sends the liquid having a low degassing degree inside the liquid ejecting portion 15, to the degas module 41 via the liquid return flow path 31, the liquid storing portion 32, and the liquid supply flow path 30, and returns the degassed liquid to the liquid ejecting portion 15. Accordingly, the generation of air bubbles and the growth of air bubbles in the pressure chamber 86 can be suppressed.

4. When the viscosity of the liquid inside the pressure chamber 86 increases, the ejection performance of ejecting the liquid from the nozzle 24 may deteriorate. The viscosity increase of the liquid may be eliminated by increasing the flow rate of the liquid that was caused to flow by the flow path flowing mechanism 39. The control portion 111 increases the flow rate of the liquid flowing inside the liquid supply flow path 30 and inside the liquid return flow path 31 by the flow path flowing mechanism 39 when the viscosity increase of the liquid is estimated. Accordingly, the control portion 111 drives and controls the flow path flowing mechanism 39 according to the state inside the pressure chamber 86, and thus it is possible to reduce the functional deterioration of the flow path flowing mechanism 39 while suppressing the deterioration of the ejection performance due to the viscosity increase of the liquid.

5. The air bubbles inside the pressure chamber 86 may be improved by increasing the flow rate of the liquid inside the liquid supply flow path 30 and inside the liquid return flow path 31. When the viscosity increase of the liquid is estimated, the control portion 111 drives the flow path flowing mechanism 39 to increase the flow rate of the liquid inside the liquid supply flow path 30 and inside the liquid return flow path 31, and to lower the vacuum degree of the degas module 41. Accordingly, it is possible to suppress the generation of air bubbles by utilizing the flow of the liquid that eliminates the viscosity increase of the liquid.

6. Regarding the nozzle 24, air bubbles are likely to grow in the nozzle 24 that does not eject the liquid than in the nozzle 24 that ejects the liquid. In this respect, the control portion 111 drives and controls the vacuum degree adjustment mechanism 41*e* based on the detecting result of the pressure chamber 86 that communicates with the nozzles 24 that are not ejecting the liquid, so that variations in the ejection performance in the plurality of nozzles 24 can be reduced.

The embodiment described above can be modified and implemented as follows. The embodiment described above and the following modified examples can be implemented in combination with each other within a technically consistent range.

The coupling position of the liquid return flow path 31 to the liquid supply flow path 30 may be changed from the position in the embodiment described above as long as the position is upstream of the liquid storing portion 32 in the supply direction A. For example, the liquid return flow path 31 may be coupled to a position between the filter unit 38 and the liquid storing portion 32 in the liquid supply flow path 30.

The liquid return flow path 31 may be constituted with three or more return flow paths or may be constituted with one return flow path.

The return valve 99 may be an open/close valve that can be switched between an open valve state and a closed valve state. In this form, the third operation may be performed by driving and controlling at least one of the supply pump 39A and the return pump 39B so that the flow rate of the liquid inside the liquid supply flow path 30 and inside the liquid return flow path 31 increases.

The flow path flowing mechanism 39 may be configured to include either one of the supply pump 39A and the return pump 39B.

Figure 11:
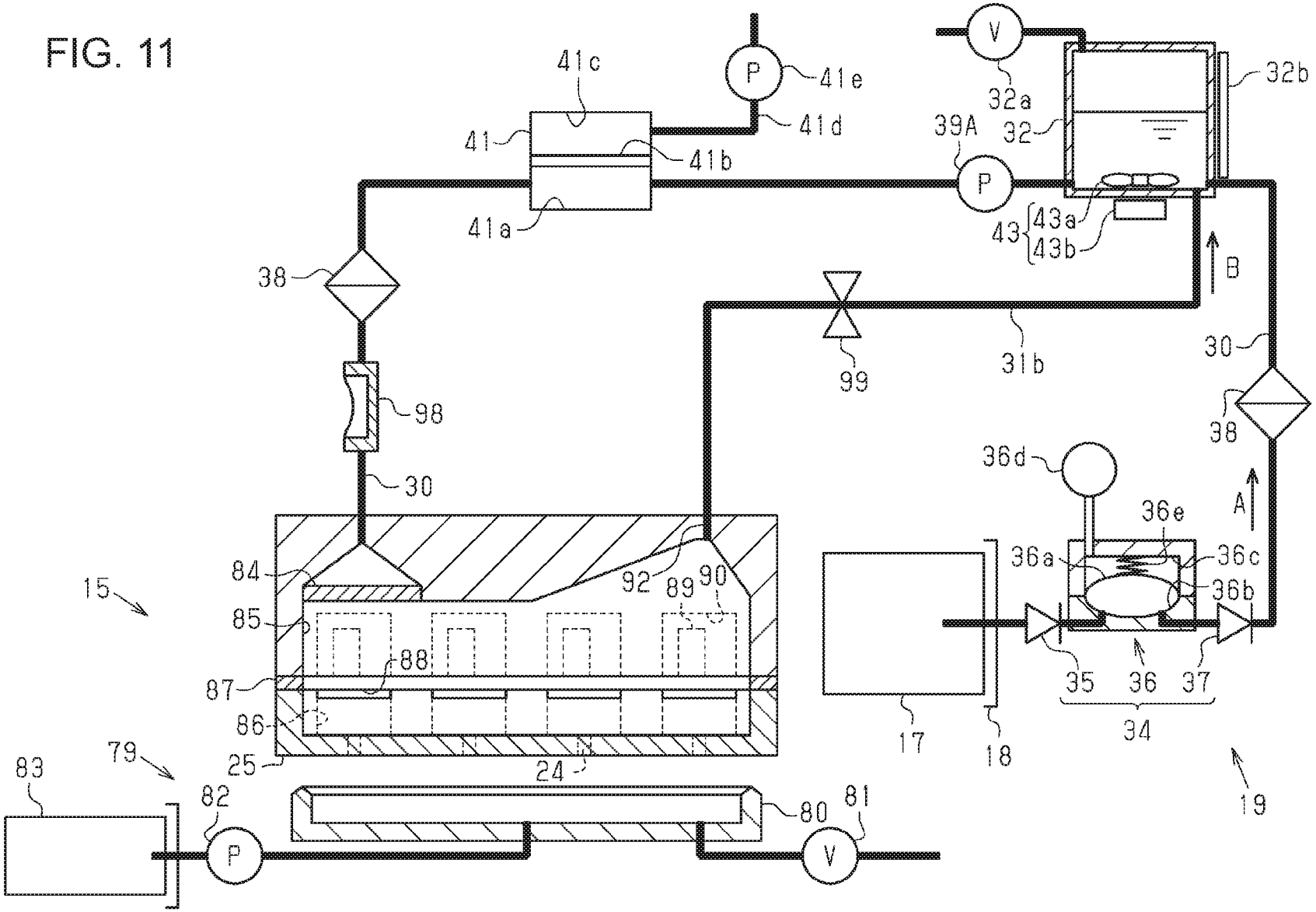
FIG. 11 is a sectional view schematically illustrating a liquid ejecting apparatus and a liquid supply portion of another embodiment.

As illustrated in FIG. 11, the liquid supply portion 19 may include the liquid supply flow path 30 and the second return flow path 31*b*. That is, the liquid return flow path 31 may be constituted with one second return flow path 31*b*. The liquid supply flow path 30 may be provided with a plurality of filter units 38 and the damper 98. For example, the liquid supply portion 19 includes the deriving pump 34, the filter unit 38, the liquid storing portion 32, the supply pump 39A, the degas module 41, the filter unit 38, and a damper 98 that are provided in the liquid supply flow path 30 in order from the upstream side of the supply direction A. For example, the liquid supply portion 19 includes the return valve 99 provided in the second return flow path 31*b*. The liquid supply portion 19 illustrated in FIG. 11 does not include the pressure adjustment apparatus 40. Accordingly, the control portion 111 may adjust the pressure of the liquid supplied to the liquid ejecting portion 15 by controlling the driving of the supply pump 39A. The control portion 111 may cause the liquid inside the liquid supply flow path 30 and inside the liquid return flow path 31 to flow by using the flow path flowing mechanism 39 constituted with the supply pump 39A and the return valve 99, thereby performing the second operation and the third operation.

The degas module 41 may include a plurality of hollow fiber membranes, and may include the space inside the hollow fiber membrane as the degassing chamber 41*a*, the decompression chamber 41*c* partitioned by the hollow fiber membrane from the degassing chamber 41*a*, the decompression flow path 41*d* connected to the decompression chamber 41*c*, and the vacuum degree adjustment mechanism 41*e* capable of adjusting the vacuum degree of the degas module 41.

The liquid ejecting portion 15 may eject the liquid from the nozzle 24 by heating the liquid inside the pressure chamber 86 with an electrothermal conversion element to cause film boiling. In this case, the state detecting mechanism 113 may include a temperature detecting element immediately below the electrothermal conversion element, and may compare the maximum temperature at the time of liquid ejection detected by the temperature detecting element with a preset threshold value or detect the ejecting state based on the difference in the change of the temperature detected the temperature detecting element.

The control portion 111 may store the history of the ejection amount of the liquid from the nozzle 24. In this mode, when there are the nozzle 24 with a small ejection amount of the liquid and the nozzle 24 with a large ejection amount of the liquid among the nozzles 24, the detection may be performed targeting the pressure chamber 86 communicating with the nozzle 24 with a small ejection amount of the liquid, by the state detecting mechanism 113.

In the liquid ejecting portion 15, as the pressure chamber 86 is positioned farther from the liquid supply flow path 30, the flow of the liquid occurring inside the pressure chamber 86 tends to be less. The control portion 111 may perform the detection for the pressure chamber 86 positioned farthest from the liquid supply flow path 30 by the state detecting mechanism 113.

The detection by the state detecting mechanism 113 for the pressure chamber 86 may be performed without distinguishing between the pressure chamber 86 communicating with the non-ejecting nozzle and the pressure chamber 86 communicating with the ejecting nozzle. In the present embodiment, for example, the step S101, the step S102, and the step S103 may be omitted in the routine illustrated in FIG. 9. The control portion 111 may estimate the generation of air bubbles and the growth of the air bubbles in the liquid or perform the viscosity determination of the liquid, based on the detecting result detected without distinguishing the nozzles 24 by the state detecting mechanism 113.

The control portion 111 may perform the first operation by increasing the vacuum degree of the degas module 41 by a predetermined value.

The control portion 111 may perform the third operation by setting the flow rate of the liquid flowing inside the liquid supply flow path 30 and inside the liquid return flow path 31 to a predetermined value.

The control portion 111 may perform the fourth operation by lowering the vacuum degree of the degas module 41 by a predetermined value.

The second operation may be omitted from the maintenance processing performed by the control portion 111. In this case, the control portion 111 may shift the processing to the step S107 after the processing of the step S105 in the routine illustrated in FIG. 9.

The flow of the liquid inside the liquid supply flow path 30 and inside the liquid return flow path 31 by the flow path flowing mechanism 39 may be stopped when the routine of the maintenance processing illustrated in FIGS. 9 and 10 is started for the first time. In this case, in the step S106, the second operation may be performed by starting the flow of the liquid inside the liquid supply flow path 30 and inside the liquid return flow path 31 by the flow path flowing mechanism 39. In the step S114 and the step S115, the flow of liquid inside the liquid supply flow path 30 and inside the liquid return flow path 31 by the flow path flowing mechanism 39 may be stopped.

The fourth operation in the step S111 may be omitted from the routine of the maintenance processing illustrated in FIGS. 9 and 10. In this case, the control portion 111 may perform the processing of increasing the vacuum degree of the degas module 41 in the step S115 and the step S117.

The vacuum adjustment of the degas module 41 by the vacuum degree adjustment mechanism 41*e* may be stopped at the beginning of the routine of the maintenance processing illustrated in FIGS. 9 and 10. In this case, the control portion 111 may start the vacuum adjustment of the degas module 41 by the vacuum degree adjustment mechanism 41*e* in the step S105. In the step S108, the control portion 111 may stop the vacuum adjustment of the degas module 41 by the vacuum degree adjustment mechanism 41*e*. The control portion 111 may omit the fourth operation in the step S111. The control portion 111 may start the vacuum driving of the degas module 41 by the vacuum degree adjustment mechanism 41*e* in the step S115 and the step S117.

The control portion 111 may not have to estimate the generation of air bubbles and the growth of air bubbles after estimating the viscosity decrease of the liquid in the step S112. That is, in the routine illustrated in FIG. 10, the step S113, the step S115, the step S116, and the step S117 may be omitted. The control portion 111 may shift the processing to the step S114 when YES is determined in the step S112. The control portion 111 may shift the processing to the step S118 when NO is determined in the step S112.

The third operation may be omitted from the maintenance processing performed by the control portion 111. In this case, the routine illustrated in FIG. 10 may be omitted in the maintenance processing. The control portion 111 may temporarily end the maintenance processing after the processing of the step S108 illustrated in FIG. 9 or when NO is determined in the step S104.

The control portion 111 may drive and control at least one of the vacuum degree adjustment mechanism 41*e* and the flow path flowing mechanism 39 based on the detecting result of the state detecting mechanism 113. In this mode, the control portion 111 may perform an operation of driving the flow path flowing mechanism 39 instead of the first operation and the second operation. When the flow path flowing mechanism 39 is driven, the flow rate of the liquid flowing toward the liquid ejecting portion 15 increases. In this case, although the vacuum degree of the degas module 41 is not adjusted by the vacuum degree adjustment mechanism 41*e*, the flow rate of the liquid flowing toward the liquid ejecting portion 15 increases, so that the generation of air bubbles and the growth of air bubbles in the liquid can be improved. Accordingly, the vacuum degree adjustment mechanism 41*e* and the degas module 41 may be omitted from the liquid ejecting apparatus 11. When a liquid having a high degassing degree is stored inside the liquid supply source 17 and the generation of air bubbles and the growth of air bubbles are estimated, the liquid is supplied from the liquid supply source 17 to the liquid storing portion 32, so that the liquid having a high degassing degree may be caused to flow by the flow path flowing mechanism 39.

Instead of the first operation and the second operation, the control portion 111 may select and drive one of the vacuum degree adjustment mechanism 41*e* and the flow path flowing mechanism 39 each time. In this case, for example, the control portion 111 may alternately drive the vacuum degree adjustment mechanism 41*e* and the flow path flowing mechanism 39 each time when the generation of air bubbles and the growth of air bubbles in the pressure chamber 86 are estimated based on the detecting result of the state detecting mechanism 113. The flow path flowing mechanism 39 of this mode may be capable of flowing the liquid inside the liquid supply flow path 30 toward the liquid ejecting portion 15. That is, the return pump 39B and the return valve 99 provided in the liquid return flow path 31 may be omitted from the flow path flowing mechanism 39. The liquid return flow path 31 may be omitted from the liquid ejecting apparatus 11.

The effect of this form will be described.

7. The air bubbles inside the pressure chamber 86 may be improved by increasing the flow rate of the liquid flowing toward the liquid ejecting portion 15. The control portion 111 drives and controls at least one of the vacuum degree adjustment mechanism 41*e* and the flow path flowing mechanism 39 based on the detecting result of the state detecting mechanism 113. Accordingly, as compared with when the control portion 111 drives and controls only the vacuum degree adjustment mechanism 41*e*, the functional deterioration of the vacuum degree adjustment mechanism 41*e* can be reduced.

The liquid ejecting apparatus 11 may be a liquid ejecting apparatus that ejects or discharges a liquid other than an ink. The state of the liquid discharged from the liquid ejecting apparatus in the form of a minute amount of liquid droplets includes one with granular, tear-like, and thread-like trails. The liquid here may be any material that can be ejected from the liquid ejecting apparatus. For example, the liquid may be in a state when a substance is in a liquid phase, and may include a fluid body such as a liquid body having a high or low viscosity, a sol, gel water, other inorganic solvents, an organic solvent, a solution, a liquid resin, a liquid metal, a metal melt. The liquid includes not only a liquid as one state of a substance but also one in which particles of a functional material formed of a solid substance such as a pigment or metal particles are dissolved, dispersed, or mixed, or the like. Representative examples of the liquid include an ink, liquid crystal, or the like as described in the embodiment described above. Here, the ink includes general water-based inks and oil-based inks, and various liquid compositions such as gel inks and hot melt inks. A specific example of the liquid ejecting apparatus is, for example, an apparatus that ejects a liquid including a material such as an electrode material or a coloring material, which is used for manufacturing a liquid crystal display, an electroluminescence display, a surface emitting display, and a color filter, or the like, in a dispersed or dissolved state. The liquid ejecting apparatus may be an apparatus that ejects a bioorganic substance used in biochip manufacturing, an apparatus that ejects a liquid serving as a sample used as a precision pipette, a textile printing apparatus, a micro dispenser, or the like. A liquid ejecting apparatus may be an apparatus that ejects lubricating oil into a precision machine such as a timepiece or a camera at a pinpoint or an apparatus that sprays a transparent resin liquid such as an ultraviolet curable resin for forming a micro hemispherical lens, an optical lens, or the like used for an optical communication element or the like onto the substrate. The liquid ejecting apparatus may be an apparatus that ejects an etching liquid such as acid or alkali for etching the substrate or the like.

In the following, the technical ideas and the operational effects obtained from the embodiments described above and modified examples will be described.

A. A liquid ejecting apparatus including a liquid ejecting portion that ejects a liquid in a pressure chamber from a nozzle that communicates with the pressure chamber, a liquid supply flow path that supplies the liquid stored in a liquid storing portion to the liquid ejecting portion, a degas module provided in the liquid supply flow path, a vacuum degree adjustment mechanism configured to adjust a vacuum degree of the degas module, a state detecting mechanism configured to detect a state inside the pressure chamber, and a control portion that drives and controls the vacuum degree adjustment mechanism based on a detecting result of the state detecting mechanism.

According to this configuration, the control portion drives and controls the vacuum degree adjustment mechanism based on the detecting result of the state detecting mechanism. Accordingly, as compared with the case of using the vacuum degree adjustment mechanism that maintains a state in which the control of the vacuum degree is not performed and the vacuum degree is high, the functional deterioration of the vacuum degree adjustment mechanism can be reduced.

B. In the liquid ejecting apparatus, the control portion may perform a first operation that drives the vacuum degree adjustment mechanism to increase the vacuum degree of the degas module when generation of air bubbles and growth of air bubbles are estimated from the detecting result of the state detecting mechanism.

When the air bubbles generated in the pressure chamber grow, the ejection performance of ejecting the liquid from the nozzle may deteriorate. In this respect, according to this configuration, the control portion increases the vacuum degree of the degas module when the generation of air bubbles and the growth of air bubbles are estimated, so that the functional deterioration of the vacuum degree adjustment mechanism can be reduced while suppressing the deterioration of the ejection performance due to the growth of air bubbles.

C. The liquid ejecting apparatus may include a liquid return flow path that couples the liquid ejecting portion and the liquid storing portion so that the liquid supplied to the liquid ejecting portion can be returned to the liquid storing portion, and a flow path flowing mechanism configured to flow the liquid inside the liquid supply flow path and inside the liquid return flow path. In the liquid ejecting apparatus, the control portion may perform the second operation that drives the flow path flowing mechanism in a state where the vacuum degree of the degas module is adjusted when generation of air bubbles and growth of air bubbles are estimated from the detecting result of the state detecting mechanism.

According to this configuration, the control portion causes the liquid inside the liquid supply flow path and inside the liquid return flow path to flow by the flow path flowing mechanism. That is, the control portion sends the liquid having a low degassing degree inside the liquid ejecting portion, to the degas module via the liquid return flow path, the liquid storing portion, and the liquid supply flow path, and returns the degassed liquid to the liquid ejecting portion. Accordingly, the generation of air bubbles and the growth of air bubbles in the pressure chamber can be suppressed.

D. In the liquid ejecting apparatus, when a viscosity increase of the liquid is estimated from the detecting result of the state detecting mechanism, the control portion may perform a third operation that drives the flow path flowing mechanism in a state where the vacuum degree of the degas module is adjusted to increase a flow rate of the liquid inside the liquid supply flow path and inside the liquid return flow path.

When the viscosity of the liquid inside the pressure chamber increases, the ejection performance of ejecting the liquid from the nozzle may deteriorate. The viscosity increase of the liquid may be eliminated by increasing the flow rate of the liquid that was caused to flow by the flow path flowing mechanism. According to this configuration, the control portion increases the flow rate of the liquid flowing inside the liquid supply flow path and inside the liquid return flow path by the flow path flowing mechanism when the viscosity increase of the liquid is estimated. Accordingly, the control portion drives and controls the flow path flowing mechanism according to the state inside the pressure chamber, and thus it is possible to reduce the functional deterioration of the flow path flowing mechanism while suppressing the deterioration of the ejection performance due to the viscosity increase of the liquid.

E. In the liquid ejecting apparatus, when the viscosity increase of the liquid is estimated from the detecting result of the state detecting mechanism, the control portion may perform a fourth operation that lowers the vacuum degree of the degas module in addition to the third operation.

The air bubbles inside the pressure chamber may be improved by increasing the flow rate of the liquid inside the liquid supply flow path and inside the liquid return flow path. When the viscosity increase of the liquid is estimated, the control portion drives the flow path flowing mechanism to increase the flow rate of the liquid inside the liquid supply flow path and inside the liquid return flow path, and to lower the vacuum degree of the degas module. Accordingly, it is possible to suppress the generation of air bubbles by utilizing the flow of the liquid that eliminates the viscosity increase of the liquid.

F. In the liquid ejecting apparatus, the liquid ejecting portion may have a plurality of the pressure chambers and a plurality of the nozzles that communicate with each of the plurality of pressure chambers, and when there are a non-ejecting nozzle that does not eject the liquid and an ejecting nozzle that ejects the liquid among the plurality of nozzles, the control portion may drive and control the vacuum degree adjustment mechanism based on a detecting result of the state detecting mechanism for the pressure chamber communicating with the non-ejecting nozzle.

Regarding the nozzle, air bubbles are likely to grow in the nozzle that does not eject the liquid than in the nozzle that ejects the liquid. In this respect, according to this configuration, the control portion drives and controls the vacuum degree adjustment mechanism based on the detecting result of the pressure chamber that communicates with the nozzles that are not ejecting the liquid, so that variations in the ejection performance in the plurality of nozzles can be reduced.

G. A maintenance method of a liquid ejecting apparatus including a liquid ejecting portion that ejects a liquid in a pressure chamber from a nozzle that communicates with the pressure chamber, a liquid supply flow path that supplies the liquid stored in a liquid storing portion to the liquid ejecting portion, a degas module provided in the liquid supply flow path, a vacuum degree adjustment mechanism configured to adjust a vacuum degree of the degas module, and a state detecting mechanism configured to detect a state inside the pressure chamber, includes driving the vacuum degree adjustment mechanism based on a detecting result of the state detecting mechanism. According to this method, the same effect as that of the liquid ejecting apparatus can be obtained.

H. A liquid ejecting apparatus includes a liquid ejecting portion that pressurizes a liquid in a pressure chamber with an actuator to eject the liquid from a nozzle that communicates with the pressure chamber, a liquid supply flow path that supplies the liquid stored in a liquid storing portion to the liquid ejecting portion, a degas module provided in the liquid supply flow path, a vacuum degree adjustment mechanism configured to adjust a vacuum degree of the degas module, a flow path flowing mechanism configured to flow the liquid inside the liquid supply flow path toward the liquid ejecting portion, a state detecting mechanism configured to detect a state inside the pressure chamber, and a control portion that drives and controls at least one of the vacuum degree adjustment mechanism and the flow path flowing mechanism based on a detecting result of the state detecting mechanism.

The air bubbles inside the pressure chamber may be improved by increasing the flow rate of the liquid flowing toward the liquid ejecting portion. The control portion drives and controls at least one of the vacuum degree adjustment mechanism and the flow path flowing mechanism based on the detecting result of the state detecting mechanism. Accordingly, as compared with when the control portion drives and controls only the vacuum degree adjustment mechanism, the functional deterioration of the vacuum degree adjustment mechanism can be reduced.

What is claimed is:

1. A liquid ejecting apparatus comprising:

a liquid ejecting portion that ejects a liquid in a pressure chamber from a nozzle that communicates with the pressure chamber;

a liquid supply flow path that supplies the liquid stored in a liquid storing portion to the liquid ejecting portion;

a degas module provided in the liquid supply flow path;

a vacuum degree adjustment mechanism configured to adjust a vacuum degree of the degas module;

a state detecting mechanism configured to detect a state inside the pressure chamber; and a control portion that drives and controls the vacuum degree adjustment mechanism based on a detecting result of the state detecting mechanism, wherein the control portion performs a first operation that drives the vacuum degree adjustment mechanism to increase the vacuum degree of the degas module from a reference vacuum degree to a first vacuum degree that is higher than the reference vacuum degree when generation of air bubbles and growth of air bubbles are estimated from the detecting result of the state detecting mechanism, the estimation based on a comparing a volume of air bubbles to a reference volume.

2. The liquid ejecting apparatus according to claim 1, further comprising:

a liquid return flow path that couples the liquid ejecting portion and the liquid storing portion so that the liquid supplied to the liquid ejecting portion can be returned to the liquid storing portion; and a flow path flowing mechanism configured to flow the liquid inside the liquid supply flow path and inside the liquid return flow path, wherein when generation of air bubbles and growth of air bubbles are estimated from the detecting result of the state detecting mechanism, the control portion performs a second operation that drives the flow path flowing mechanism in a state where the vacuum degree of the degas module is adjusted.

3. The liquid ejecting apparatus according to claim 2, wherein when a viscosity increase of the liquid is estimated from the detecting result of the state detecting mechanism, the control portion performs a third operation that drives the flow path flowing mechanism in a state where the vacuum degree of the degas module is adjusted to increase a flow rate of the liquid inside the liquid supply flow path and inside the liquid return flow path.

4. The liquid ejecting apparatus according to claim 3, wherein when the viscosity increase of the liquid is estimated from the detecting result of the state detecting mechanism, the control portion performs a fourth operation that lowers the vacuum degree of the degas module in addition to the third operation.

5. The liquid ejecting apparatus according to claim 1, wherein the liquid ejecting portion has a plurality of the pressure chambers and a plurality of the nozzles that communicate with each of the plurality of pressure chambers, and when there is a non-ejecting nozzle that does not eject the liquid and an ejecting nozzle that ejects the liquid among the plurality of nozzles, the control portion drives and controls the vacuum degree adjustment mechanism based on a detecting result of the state detecting mechanism for the pressure chamber communicating with the non-ejecting nozzle.

6. A maintenance method of a liquid ejecting apparatus including a liquid ejecting portion that ejects a liquid in a pressure chamber from a nozzle that communicates with the pressure chamber, a liquid supply flow path that supplies the liquid stored in a liquid storing portion to the liquid ejecting portion, a degas module provided in the liquid supply flow path, a vacuum degree adjustment mechanism configured to adjust a vacuum degree of the degas module, and a state detecting mechanism configured to detect a state inside the pressure chamber, the maintenance method comprising:

driving the vacuum degree adjustment mechanism based on a detecting result of the state detecting mechanism; and performing a first operation that drives the vacuum degree adjustment mechanism to increase the vacuum degree of the degas module from a reference vacuum degree to a first vacuum degree that is higher than the reference vacuum degree when generation of air bubbles and growth of air bubbles are estimated from the detecting result of the state detecting mechanism, the estimation based on a comparing a volume of air bubbles to a reference volume.

7. The maintenance method of the liquid ejecting apparatus according to claim 6, wherein the liquid ejecting apparatus further includes a liquid return flow path that couples the liquid ejecting portion and the liquid storing portion so that the liquid supplied to the liquid ejecting portion can be returned to the liquid storing portion, and a flow path flowing mechanism configured to flow the liquid inside the liquid supply flow path and inside the liquid return flow path, and the method further comprises performing a second operation that drives the flow path flowing mechanism in a state where the vacuum degree of the degas module is adjusted when generation of air bubbles and growth of air bubbles are estimated from the detecting result of the state detecting mechanism.

8. The maintenance method of the liquid ejecting apparatus according to claim 7, further comprising:

performing a third operation that drives the flow path flowing mechanism in a state where the vacuum degree of the degas module is adjusted to increase a flow rate of the liquid inside the liquid supply flow path and inside the liquid return flow path when a viscosity increase of the liquid is estimated from the detecting result of the state detecting mechanism.

9. The maintenance method of the liquid ejecting apparatus according to claim 8, further comprising:

performing a fourth operation that lowers the vacuum degree of the degas module in addition to the third operation when the viscosity increase of the liquid is estimated from the detecting result of the state detecting mechanism.

10. The maintenance method of the liquid ejecting apparatus according to claim 6, wherein the liquid ejecting portion has a plurality of the pressure chambers and a plurality of the nozzles that communicate with each of the plurality of pressure chambers, and the method further comprises driving and controlling the vacuum degree adjustment mechanism based on the detecting result of the state detecting mechanism for the pressure chamber communicating with a non-ejecting nozzle when there is a non-ejecting nozzle that does not eject the liquid and an ejecting nozzle that ejects the liquid among the plurality of nozzles.

* * * * *